United States Patent [19]

Lock et al.

[11] Patent Number: 4,480,540

[45] Date of Patent: Nov. 6, 1984

[54] PRINTING APPARATUS AND METHOD

[75] Inventors: William E. Lock, Horseheads; Donald C. Peters, Savona, both of N.Y.

[73] Assignee: Corning Glass Works, Corning, N.Y.

[21] Appl. No.: 332,726

[22] Filed: Dec. 21, 1981

[51] Int. Cl.[3] ..... B41F 17/18; B41F 5/22

[52] U.S. Cl. ..... 101/36; 101/38 A; 101/171; 101/217; 101/425

[58] Field of Search ..... 101/38–40, 101/36, 425, 171, 177, 217

[56] References Cited

U.S. PATENT DOCUMENTS

| | | | |
|---|---|---|---|
| 155,072 | 9/1874 | Davies | 101/38 R |
| 2,917,994 | 12/1959 | Tripp | 101/36 |
| 3,302,561 | 2/1967 | Edwards | 101/38 R |
| 3,398,678 | 8/1968 | Usko | 101/38 R |
| 3,443,515 | 5/1969 | Smith et al. | 101/38 R |
| 3,685,441 | 8/1972 | Aebersold et al. | 101/38 A |
| 3,720,162 | 3/1973 | James | 101/39 |
| 3,866,266 | 2/1975 | Dunlap | 101/425 |
| 3,867,881 | 2/1975 | Blattner | 101/38 R |
| 3,915,087 | 10/1975 | Tiemann | 101/38 R |
| 3,977,318 | 8/1976 | Cohan | 101/38 A |
| 4,261,749 | 4/1981 | Johnson . | |
| 4,280,939 | 7/1981 | Johnson . | |
| 4,292,104 | 9/1981 | Heimbach-Johnson . | |
| 4,344,362 | 8/1982 | Ishii | 101/425 |

FOREIGN PATENT DOCUMENTS

| | | | |
|---|---|---|---|
| 973197 | 2/1951 | France | 101/40 |
| 55428 | 6/1952 | France | 101/38 R |
| 15068 | 6/1968 | Japan | 101/38 R |
| 1284841 | 8/1972 | United Kingdom | 101/38 R |

*Primary Examiner*—William Pieprz
*Attorney, Agent, or Firm*—B. R. Turner

[57] ABSTRACT

The apparatus of the present invention includes a rotatably driven turret carrying one or more collector means at selected radial and angular positions, and transfer means synchronously driven with said turret for depositing on each of said collector means a design configuration. The turret and each of the transfer means share a common point of rotation along respective central axes thereof.

19 Claims, 33 Drawing Figures

Fig. 19A
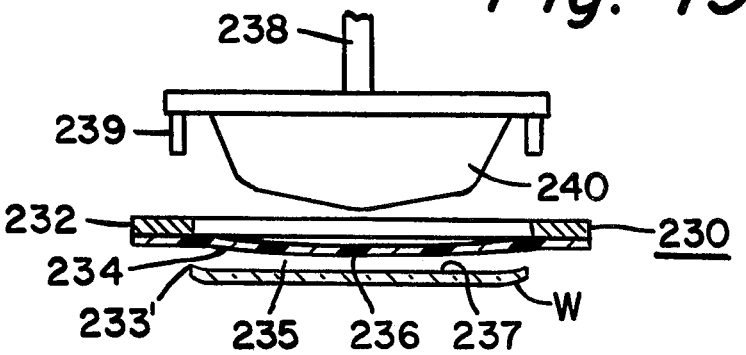
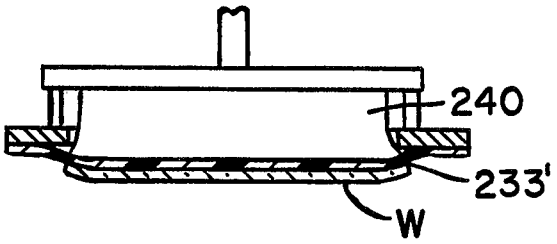
Fig. 19B
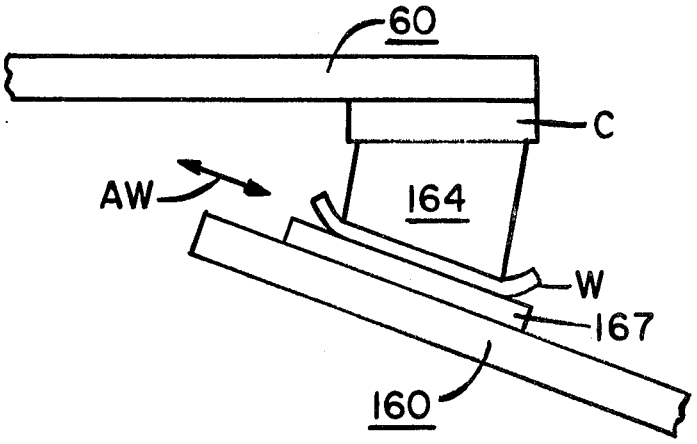
Fig. 20E

PRINTING APPARATUS AND METHOD

BACKGROUND OF THE INVENTION

The present invention relates to a printing apparatus and a method of carrying out various printing functions. Although many applications for the invention may be possible, the disclosure herein emphasizes the application to ware decoration. It should be understood however that articles of many types may be printed or decorated using the apparatus and method of the present invention and such applications are part of the invention herein.

In multicolor ware decoration, speed, versatility, ease of setup, quality of reproduction, accuracy of registration, and cost effectiveness are important factors to consider. State of the art decorating devices approach some but not all of the above factors satisfactorily. The present invention was developed for various reasons including a desire to both take advantage of the latest ink and elastomer technology and to maximize printing rates without sacrifice of registration.

The machine configuration of the present invention makes use of two geometric relationships. First, a cone when placed on the flat surface and rolled, will trace an arc centered at the same point as the apex of the cone. The cone will travel along this path freely with no slipping between the surfaces. Second, two cones sharing the same apex and placed side by side will roll one on the other without slipping along the line of contact. As will be shown below, by choosing the proper ratio of circumferences between the first mentioned cone and the arc traced in the plane of the flat surface, the cone will roll an integral number of revolutions as it travels one revolution about the traced arc. Similarly the proper choice of circumference ratios of cones will produce integral rotations with each other and the arc. Therefore, discrete locations of the cone will always match up with discrete locations along the arc in the flat surface. Accordingly, a special case of synchronous motion may be defined.

The two cones and the flat surface may be driven in synchronism by a proper gearing arrangement, from which a device may be produced which will establish pattern registration from one set of cones to another and the surface as hereinafter illustrated.

It should be further understood that the device of the present invention may be operated in various ways to establish a degree of versatility not heretofore available in the prior art. The device herein described may be adapted for printing multicolor designs on flat, hollow, and other odd shaped ware inside or out, with high quality, speed, and simplified set up for each of the various types of ware to be decorated.

In a series of related U.S. patent application Ser. Nos. 332,722; 332,723; 332,724 and 332,725 filed this same date and assigned to the assignee herein, various subcombinations for the present invention are disclosed in detail. It should be understood that, to the extent necessary, the teachings of said applications should be considered incorporated by reference herein.

SUMMARY OF THE INVENTION

The apparatus of the present invention includes a rotatably driven turret carrying one or more collector means at selected radial and angular positions, and transfer means synchronously driven with said turret for depositing on each of said collector means a design configuration. The turret and each of the transfer means share a common point of rotation along respective central axes thereof. The invention includes a method of printing from collectors about a central location.

DESCRIPTION OF THE DRAWINGS

FIGS. 1-3(A)-(C) show the geometric relations between the various components and illustrate the operating principle of the apparatus of the present invention.

FIGS. 19A and 19B are side sections of the flexible membrane printing head and ware in two positions.

DESCRIPTION OF THE PREFERRED EMBODIMENT

Figure 1:
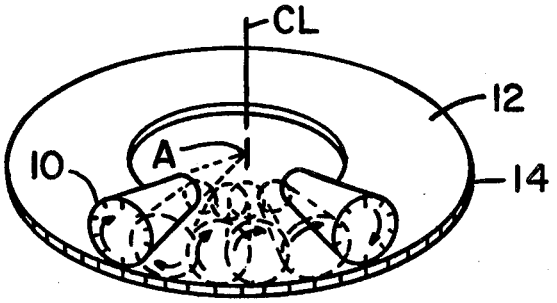

The machine configuration of this invention makes use of two geometric relationships. First, referring to FIG. 1, a cone 10 (truncated as shown), having an apex point A, when placed on a flat surface 12 and rolled, will trace a circular arc or disc 14 about a center line CL and having its apex A located thereon. The cone 10 will travel along this path freely with no slipping. Second, referring to FIG. 2, two cones, the first mentioned 10 above and another 16 having the same apex A and placed side by side, roll one on the other with no slipping along the line of contact or ray 18.

Figure 2:
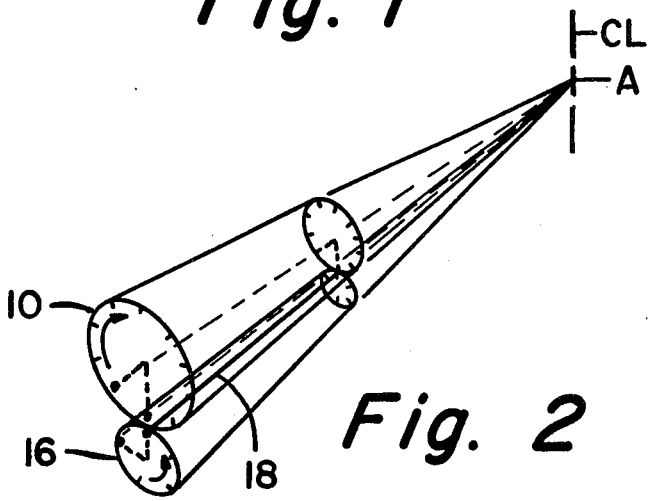
Figure 3:
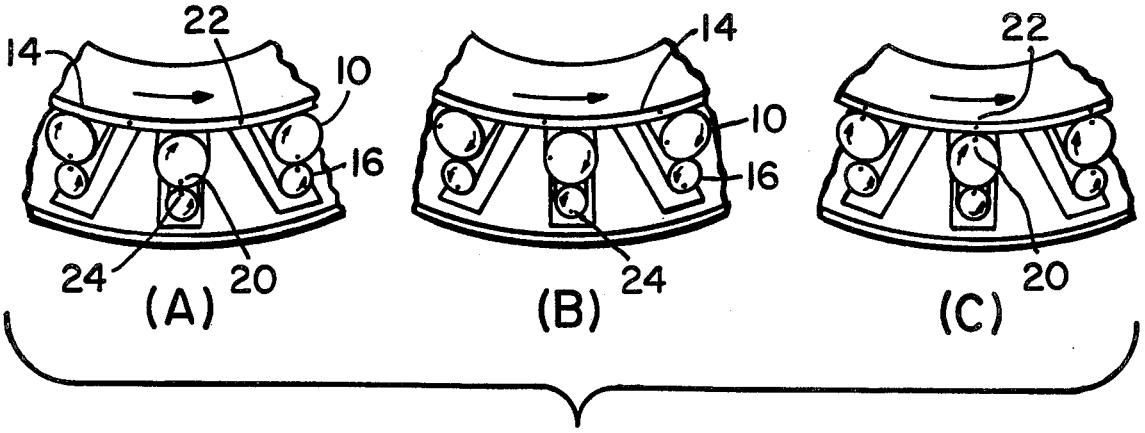

FIG. 3 at (A)-(C) illustrates that by combining the principles of FIGS. 1 and 2 and by choosing the proper ratio of circumferences between the arc 14 and cone 10, the latter will roll an integral number of revolutions as it travels one revolution around arc 14. This means that discrete locations 20 on the cone 10 will always match up with the discrete locations 22 on the arc 14. Likewise by choosing the proper ratios of circumferences between the two cones 10 and 16, one will rotate an integral number of times for each revolution of the other. Thus, discrete locations 24 on the cone 16 will always match those discrete locations 20 on cone 10 as the cones are continuously rotated.

Figure 4:
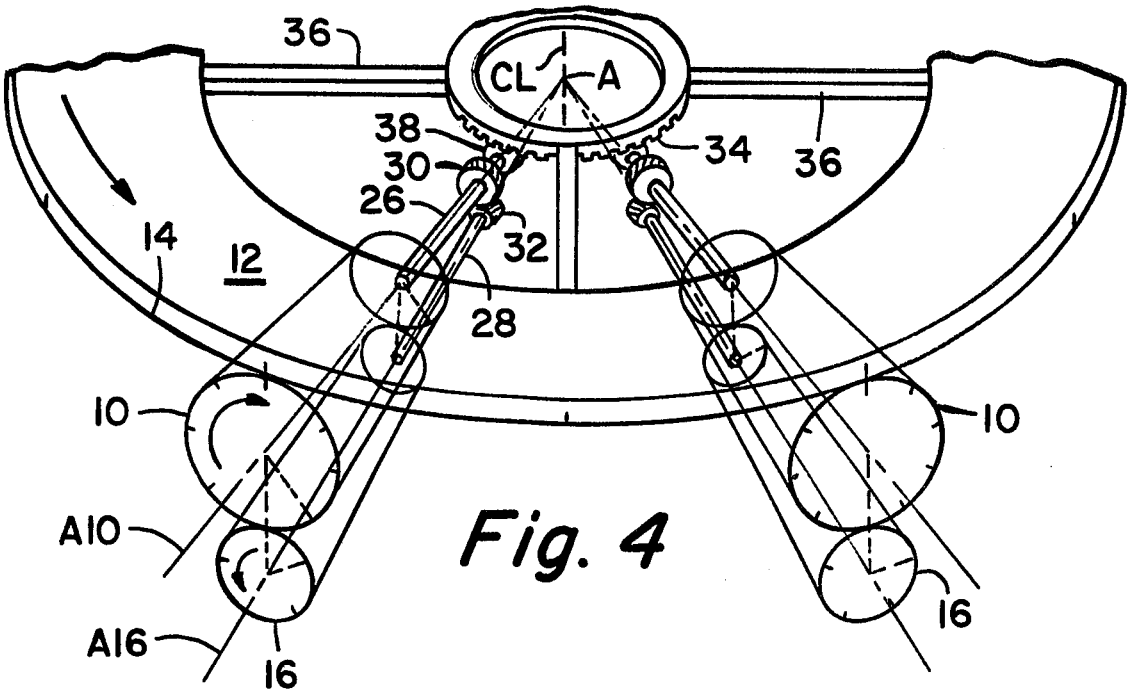
FIG. 4 is a schematic of the apparatus components of the invention.

FIG. 4 shows that the cones 10 and 16 can be geared one to the other and positively driven at the no slip ratio via respective mounting shafts 26 and 28 carrying spiral bevel gears 30 and 32. The same is true of the flat surface 12 and cone 10. FIG. 4 shows rotating flat annular surface 12 with an associated ring gear 34 carried by webs 36. The ring gear 34 drives multiple sets of the exemplary cones 10 and 16 via spiral bevel pinion gears 38 mating with ring gear 34. The cones 10 and 16 are themselves geared to one another as described above. Gears 30, 32, 34 and 38, flat annular surface 12 and cones 10 and 16 all share the same apex A as a point of rotation. Cones 10 and 16 are fixed in space, so that they rotate about their respective axes A-10, and A-16. Thus, rotation of flat annular surface 12 as defined by disc 14, and the above mentioned gearing imparts rotational motion to cones 10 and 16 only about axes A-10 and A-16. Multiple sets of cones can be placed around the circumference of the flat surface 12 and be driven by the same ring gear 34.

FIGS. 3 and 4 demonstrate that several sets of the cones 10 and 16 when placed around the periphery of the flat surface 12 can be timed one with another to cause synchronization of the respective discrete locations 20, 24 and 22, hereinafter referred to as timing marks.

Figure 6:
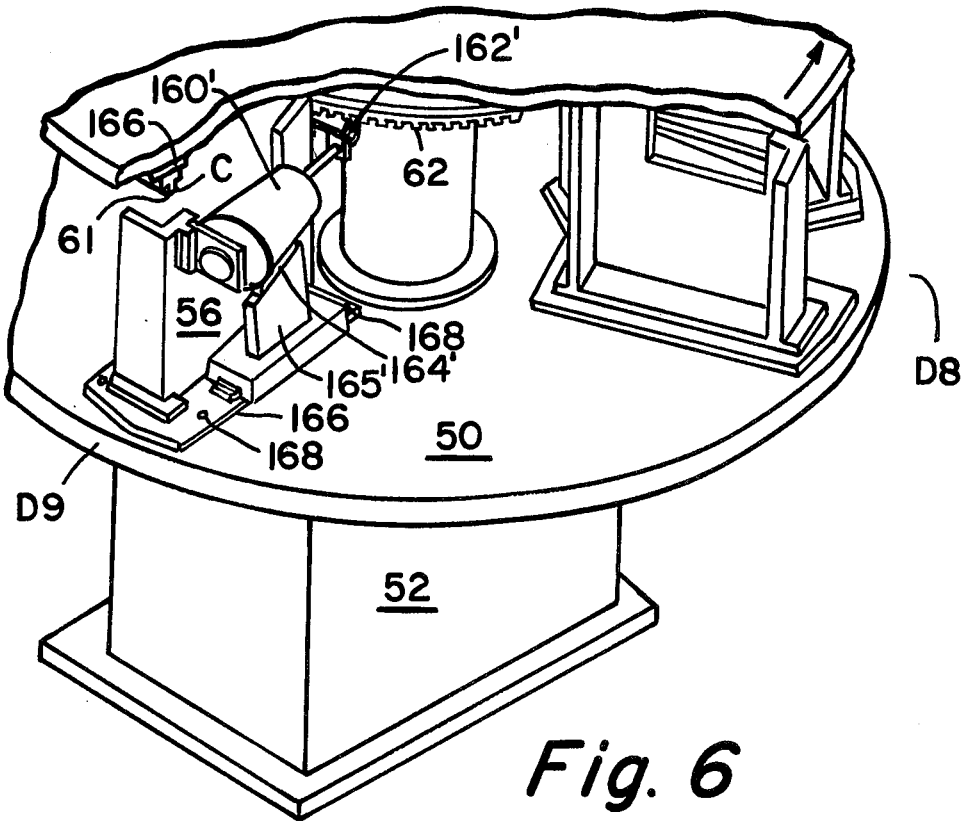
FIGS. 5 and 6 are detailed views of the apparatus showing print, print transfer, load and clean stations of the invention.
Figure 5:
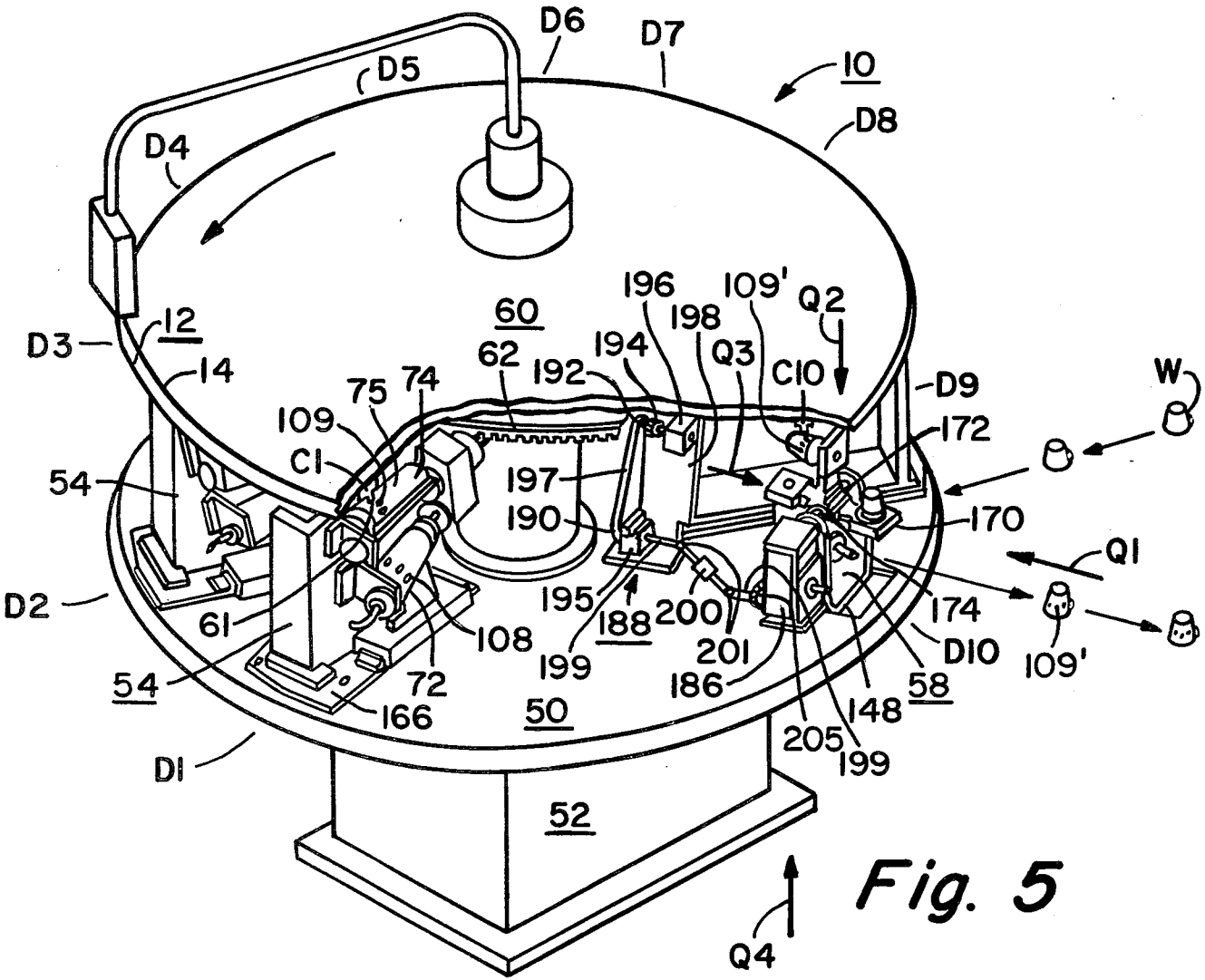

The invention is illustrated in greater detail in FIGS. 5 and 6 and includes a stationary base table 50 mounted on a machine base frame 52 that houses a continuous motion cam drive such as a model 362, manufactured by Ferguson Machine Co., (not illustrated). In a preferred embodiment the table 50 may be divided into ten (10) equally spaced divisions or stations D1–D10. Eight (8) printing station assemblies 54 are rigidly mounted, one each, at eight of the stations D1–D8 around the periphery of the table 50. One cleaning roll assembly 56 is also mounted to the table 50 at station D9, and one cam driven, arc following, print transfer assembly 58 that indexes water W into position for decorating is located at station D10. More or less divisions and arrangements are possible depending on the application.

Hereinafter suffix reference numerals are dropped where position is not relevant. A rotatably mounted turret table 60, driven by the continuous motion cam drive housed in the base of the frame 52 is adapted to rotate and carry 10 collectors C1–C10 (two shown). A ring gear 62 is carried by the turret 60 and functions as described above in reference to FIG. 4.

Figure 7:
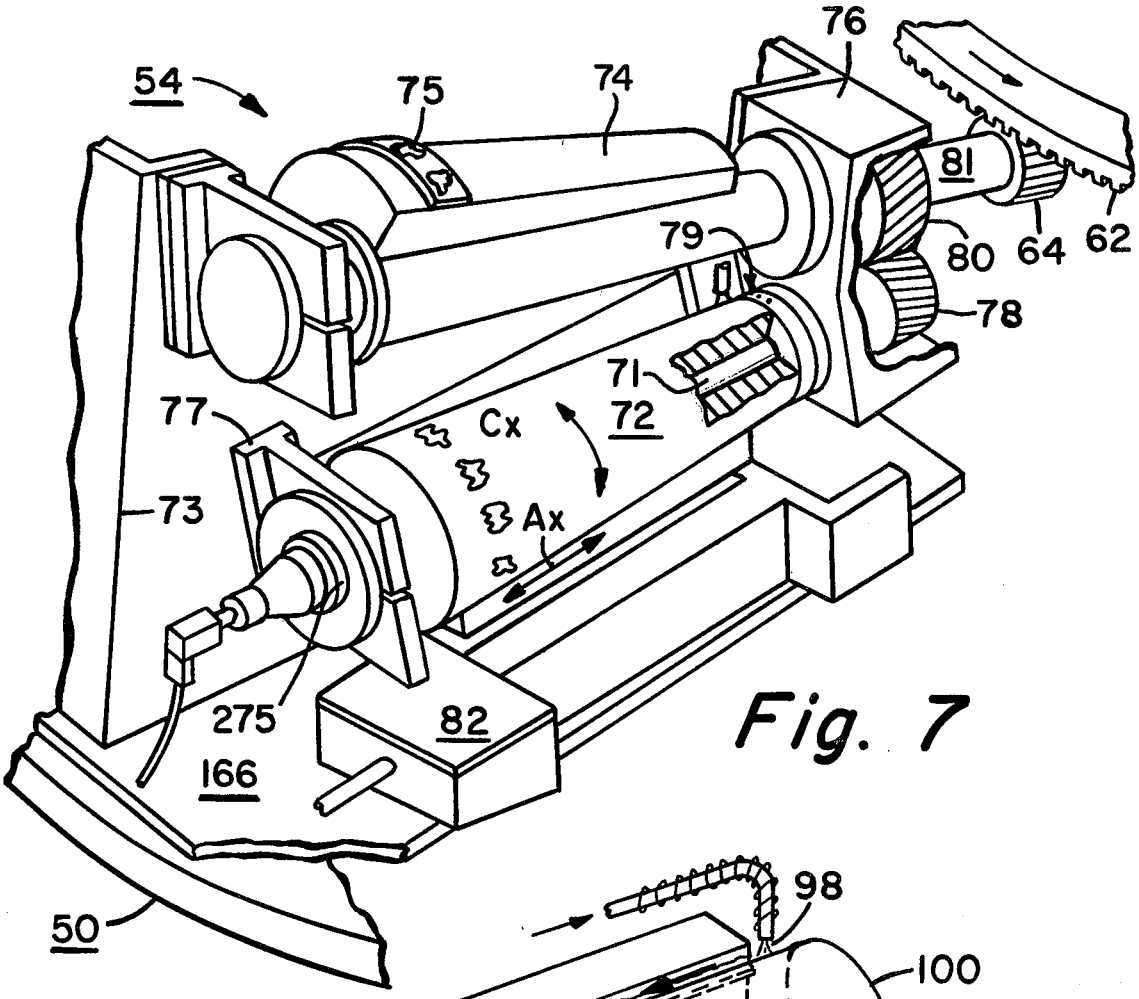
FIGS. 7 and 8 are illustrative specific details of the printing station and inking apparatus.

FIG. 7 is an illustration of a single printing station assembly 54. It includes a vertical mounting frame 73, attached to table 50, onto which are mounted one etch cone 72 sleeved over shaft 71, one transfer cone 74 carrying silicone transfer surface 75, a gear box 76 which houses two angular bevel gears 78 and 80, respectively coupled to etch cone 72 and transfer cone 74, and a pinion gear 64 carried outside of gear box 76 by shaft extension 81 of gear 80. The printing station assembly 54 also includes an ink application assembly 82 detailed in FIG. 8 and described hereinafter.

Drive power for each print station assembly 54 comes from the rotating ring gear 62 which powers pinion 64 mounted commonly with angular bevel gear 80 and transfer cone 74. The shaft 71 carrying etch cone 72 is preferably turned in a 2:1 ratio with the transfer cone 74 via gear combination 78-80.

Etch cone 72 may be adjusted axially in the direction of double headed arrow Ax by means of a collar clamp 275 mounted in support arm 77 of frame 73. The etch cone 72 may also be adjusted circumferentially in the direction of double headed arrow Cx by locking screws 79 engaging shaft 71. The axial and circumferential position of transfer cone 74 may also be adjusted in a similar manner. (Not detailed) Thus the axial and circumferential locations of the respective etch and transfer cones 72 and 74 may be adjusted for correct registration of design portions hereinafter described.

Figure 8:
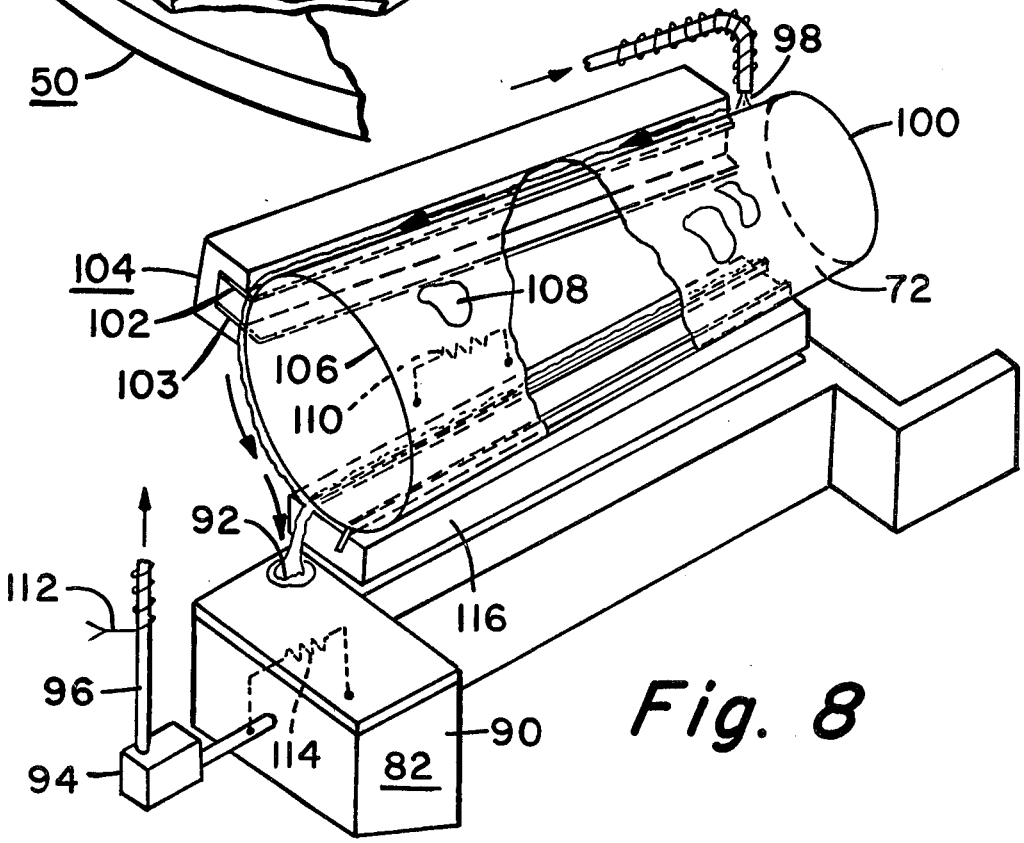

FIG. 8 shows a detailed illustration of a preferred embodiment of the ink application assembly 82. A heated bath 90 holds a quantity of liquid ink 92. A pump 94, such as a Gerotor manufactured by W. H. Nichols Co., connected in flow communication with the bath 90, circulates ink 92 via a heated pipe 96 to outlet 98 at an inboard or small end 100 of etch cone 72. The ink 92 is urged along the length of the etch cone 72 (see arrows) to the outboard or large end 106 thereof by a a free floating applicator blade assembly 104 including upper and lower blades 102 and 103, respectively. Because the angle of incline of the top of blade 102 is higher at the inboard end 100 of etch cone 72 than the outboard end 106, and because the rotating cone surface 72 moves the viscous fluid against the blade 102 causing a high pressure region within the ink 92 along the interface therebetween, the ink 92 travels along the applicator blade 102-etch cone 72 interface from the smaller to the larger end. Thereafter the ink 92 follows the cone surface near the larger end 106 back to the ink bath 90 completing the circulation path. The circulation maintains a continuous supply of ink 92 to fill design depressions 108 in the etch cone surface. Respective upper and lower blades 102 and 103 also act as doctor blades to remove excess ink 92.

In the present invention it is intended that the inks 92 be of a thermoplastic type. It is also required that they are maintained at a selected temperature at or near the melting point or a temperature at which they exhibit a suitable viscosity. Thus, etch cone 72, pipe 96 and bath 90 are heated by resistance heaters 110, 112 and 114, respectively, to maintain the ink at a suitable working viscosity.

Also shown in the illustration of FIG. 8, a free floating doctor blade assembly 116, which is similar in construction to the applicator blade assembly 104, insures that all the ink 92 is scraped from the etch cone 72. It has been found that applicator blade assembly 104 is capable of both application and doctoring. Thus doctor blade assembly 116 is usually held in a standby mode in the event of a failure of the former.

Figure 9:
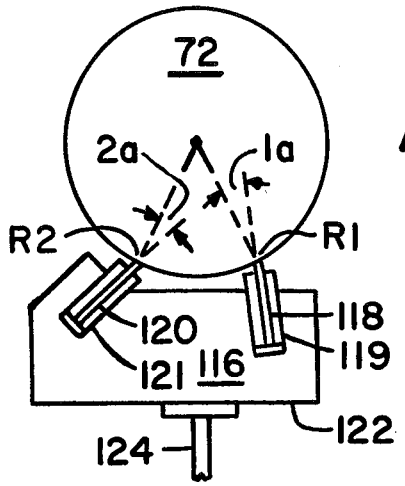
FIG. 9 is a schematic of a doctoring feature of the present invention.
Figure 10A:
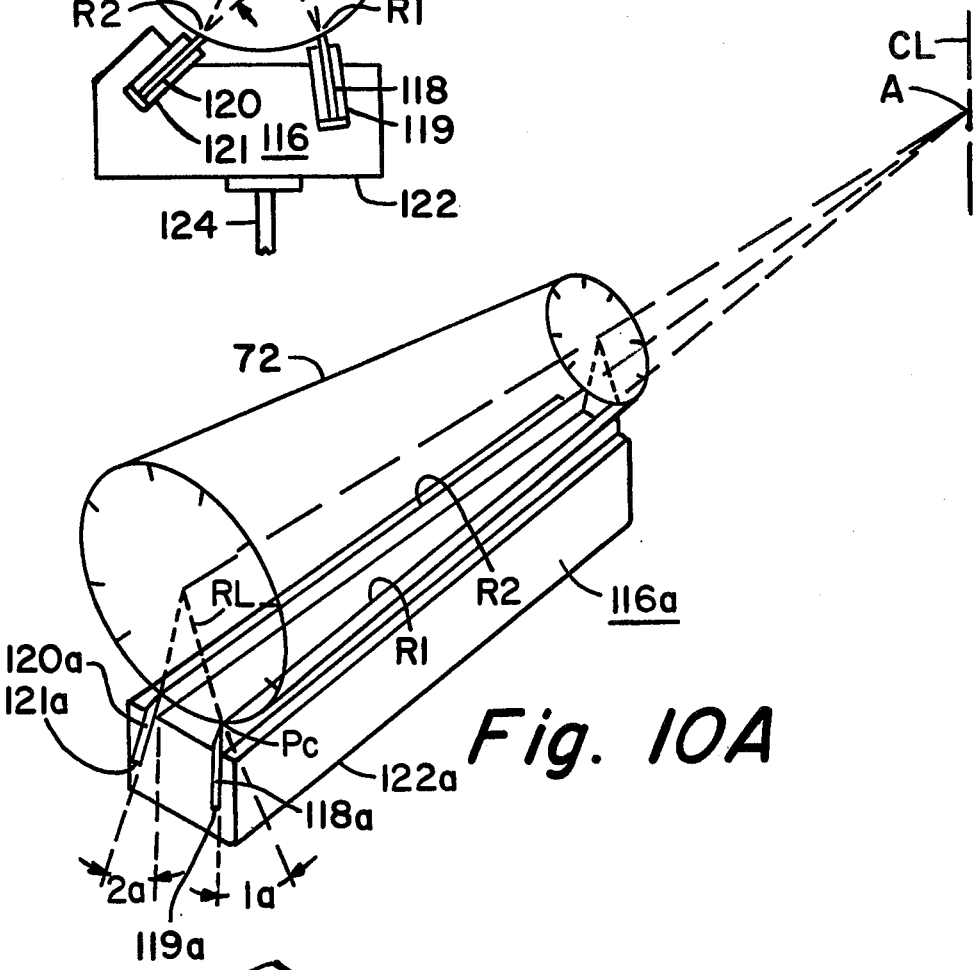
FIGS. 10A-10C illustrate schematic alternative embodiments of the doctoring feature.
Figure 10B:
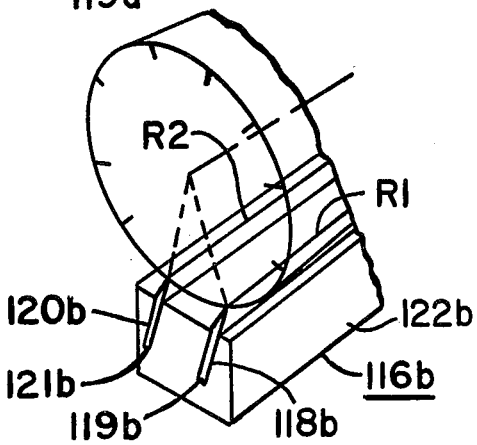
Figure 10C:
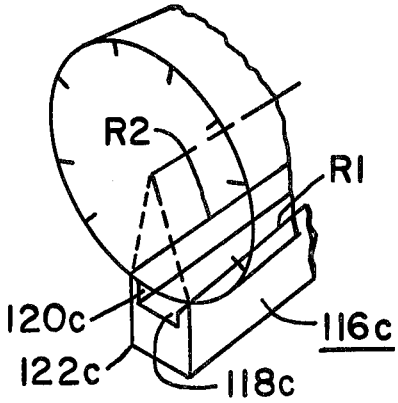

FIG. 9 better illustrates the typical relationship between the doctor blade assembly 116 and the etch cone 72. Note that the same relation holds true for applicator blade assembly 104. Respective right and left blades 118 and 120 are held in slots 119 and 121 respectively of blade holder 122 at acute angles 1*a* and 2*a* to the surface of the etch cone 72. Each is made to contact the cone 72 along a respective line of contact or ray R1,R2 of the cone surface. Two blades 118,120 are used for self alignment or seating purposes. Thus the blade holder 122 needs only to be urged towards the cone 72 to cause both blades 118 and 120 to come into intimate contact with the cone 72. Only axial positioning (i.e. into the page of the drawing) is required for the holder 122 to assure proper blade to cone contact. Pneumatic piston 124 urges the doctor blade assembly 116 into position. Piston 124 engages holder 122 by means of a suitable flexible bearing, (not shown herein) but detailed in Ser. No. 334,724 referred to above. FIGS. 10A, 10B, and 10C show other blade/cone configurations for both application and doctoring purposes.

In FIG. 10A, as in all of the contemplated applicator/doctoring assemblies, the machine center CL is coincidental with the apex A of the etch cone 72. The apex for the blades 118*a* and 120*a* in assembly 116*a*, the holder 122*a*, as well as respective locating slots 119*a*–121*a* of holder 122*a* also coincide with apex A. While the angles 1*a*, and 2*a* of blades 118*a* and 120*a* may be different from those illustrated in FIG. 9, the same resulting self alignment occurs. The angle 1*a* that the blade 118*a* makes with the cone 72 at its point of contact Pc is measured from a radial line RL of the cone 72 passing through said point of contact Pc. The angle 2*a* is measured in the same way. FIG. 10B the doctor blade assembly 116*b* has blades 118*b* and 120*b* located in respective slots 119*b*, 121*b* of holder 122*b* both leading to the right. In FIG. 10*c*, the assembly 116*c*, blades 118*c* and 120*c*, and holder 122*c* are part of an integrally formed machined block.

Referring now to FIGS. 5 and 6 the following is a brief description of the operation of the apparatus of the present invention. As turret 60 rotates, it synchronously drives etch cones 72 and transfer cones 74 carrying silicone surface 75. Each etch cone 72 receives a supply of ink as hereinbefore described. Design impressions 108, etched or engraved in the surface of etch cone 72, receive the ink after application/doctoring and an ink formed design 109 is available for offset to elastomeric silicone surface 75 carried by transfer cone 74. Silicone surface 75 and etch cone 72 roll in intimate contact against each other. The ink 92 in the impressions 108 is transferred as a semi solid cohesive mass from the former to the latter (see reference numeral 109). Collectors C1–C10 in the form of flat surface segments are mounted to and carried by turret 60. Each collector C includes an elastomeric silicone working surface 61 adapted to receive ink or design impressions thereon. The collectors C1–C10 each encounter successive printing station 54 locations D8 to D1 (counterclockwise in FIGS. 5 and 6) as the turret 60 rotates, and their working surfaces 61 receive thereon a design portion 109 of composite design 109 from each successive printing station in registration with the others. See also Ford et al. Ser. No. 173,129 filed July 28, 1980 assigned to the assignee herein for an apparatus using a cylindrical collector. At print transfer station D10 the composite design 109', formed by each successive transfer of design portions 109 from each transfer cone 74, may be transferred to ware W. The ink is transferable because each successive surface encountering the ink has a higher affinity for it than the previous one. See for example U.S. Pat. Nos. 4,280,939, 4,261,749 and 4,292,104, assigned to the assignee herein, for details of such surfaces.

It should be understood that silicone surface 75 is compressible. Accordingly, the said silicone surface is distorted or compressed along its line of contact with etch cone 72 when it comes into contact therewith. When compressed or distorted, silicone surface 75 and etch cone 72 share a common apex. The distortion is necessary in order to assure that the ink is forced against the silicone surface 75.

Figure 11:
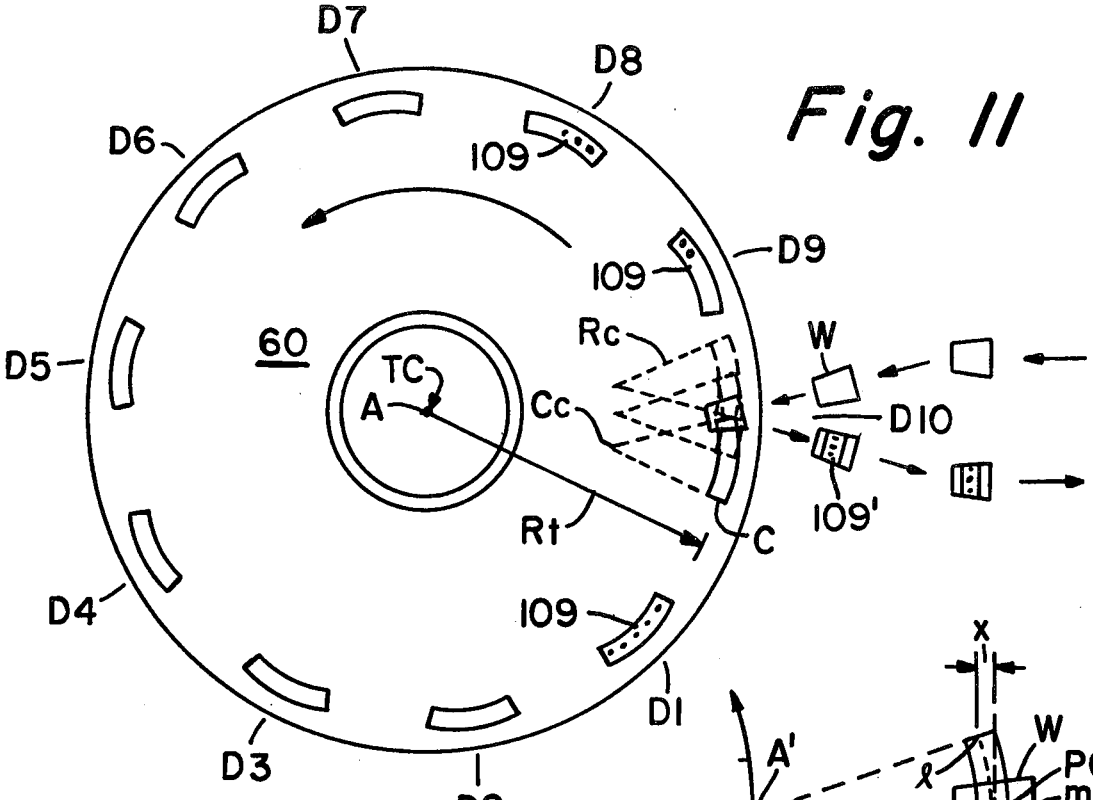
FIGS. 11-14 illustrate the concept and application of a cam following print transfer feature of the present invention.

In one embodiment of the present invention shown in FIG. 11, the rotating turret 60 holds ten (10) collectors C1–C10 in the form of equally spaced flat surface silicone arc sections onto which design portions 109 of a multicolored decoration or design 109 are printed from each silicone surface 75 of the transfer cones 74 in the respective printing stations 54 at D1–D8. The radius of curvature Rc of each collector C (sometimes hereinafter the word "radius" and "curvature" are used interchangably for simplicity) is normally determined in one embodiment by the geometry of the ware W to be decorated (i.e. a portion of its developed surface hereinafter described). Normally the curvature Rc of the collectors C will not coincide with the radius of curvature Rt of the turret table 60. However, if apex A' of the ware W can be oriented to simultaneously coincide with the center Cc of the collectors C, then a nonslip rolling action between a cone and the silicone surface of the collectors C can be established.

Figure 12A:
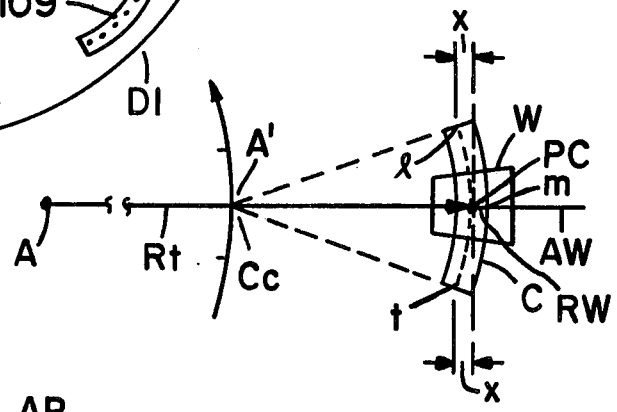
Figure 12B:
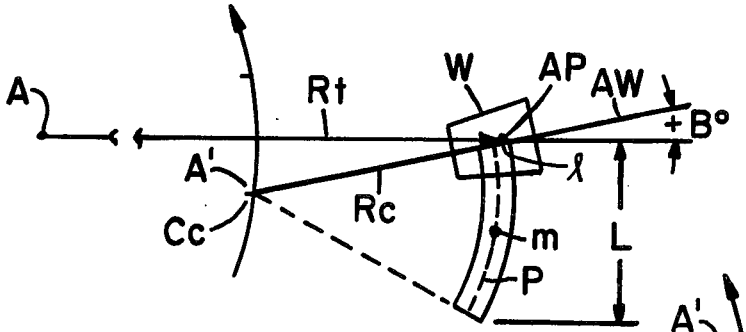
Figure 12C:
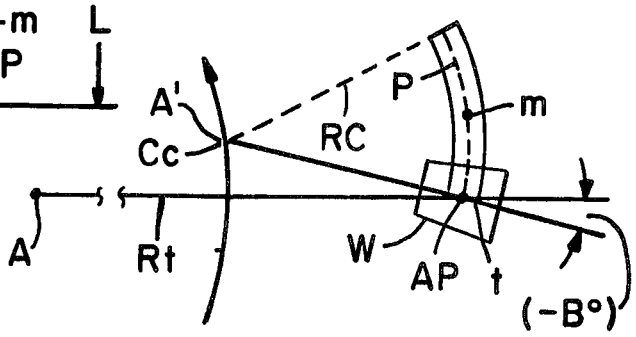

FIGS. 12A–12C show how ware W must be positioned as the turret 60 revolves and these arc sections C pass over the ware W at print transfer station D10. Such positioning requires rotational and translational manipulation. The ware W to be decorated is oriented so that it rolls against the arc sections C without slipping. The ware W must be positioned or oriented so that its apex A' is shared by the center Cc of the arc sections C at all times of contact, so that a nonstretching nonskidding rolling contact can result.

Figure 13A:
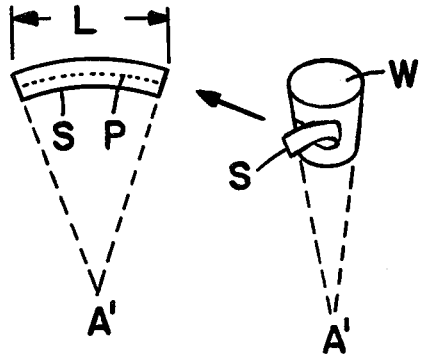

It should be noted that this requirement for changing ware position results because of the radius of curvature Rc of the arc sections C is different for each style of ware and different from the radius of curvature Rt of turret 60. The latter is specified by the radial location of the collector C on the machine turret 60. The radius of curvature Rc of the arc sections C centered at Cc is dictated by developed surface S of the conical wave W to be decorated (see FIG. 13A). The length L of the arc section C is dictated by the circumference of the ware W to be decorated along the line or path of application P, substantially centrally of arc section C.

In FIG. 12B the ware W is angularly oriented so that its apex A' is shifted to follow the center Cc of the arc section C by the angular difference B° between the radius Rc of the arc section C and the radius Rt of turret 60. The axis AW of the ware W is oriented so that ware apex A' is coincident with the center Cc of collector arc section C. In the example herein shown, the collector C is mounted so that its midpoint m coincides with turret radius Rt, but since the curvature Rc of the collector C does not coincide with the curvature Rt of the turret 60, the respective leading and trailing edges l and t of the collector C are inboard (to the left in FIG. 12A) of mid point m by x units from the full extend of the turret radius Rt. Further, since collector radius Rc has a center or origin Cc different from turret center Tc, the ware W located at turret radius Rt must be rotated about its point of contact Pc with collector C. The difference in this angular position is illustrated in FIGS. 12B & C where Rc respectively leads and lags Rt by B°. Thus, ware W must be rotated at its point of contact PC about axis AP by 2B°. In FIG. 15B ware W is shown in contact with collector C along a line of contact or ray RW shared therebetween. Contact axis AP is normal to ray RW at contact point PC. It is given that ware ray RW, measured from contact point PC, should be in radial alignment with turret radius Rt at midpoint m of collector C. Any angular or lateral shift therefrom is measured relative thereto. It is therefore required that: (1) the ware W be moved to an initial position upon engagement with leading edge l of collector C whereby its contact point PC is shifted x units inboard of its position at midpoint m and (2) the ware ray RW is rotated B° about contact axis AP counterclockwise (CCW) of turret radius Rt. (For purposes of the discussion ware axis AW and ware ray RW lie in the same plane and rotation of the ware W about contact point PC occurs about pivot axis AP also in such plane).

As the collector C advances counterclockwise (CCW) after first meeting the ware W, the ware is translated and rotated from its initial position noted above (relative to FIG. 12B) into a midway position shown in FIG. 12A. In the midway position the contact point PC is at midpoint m of collector C, lateral translation is zero units and ware axis AW is at zero degrees rotation about contact axis AP. Finally, as the collector C advances further, the ware W is translated and rotated so that axis AP is positioned x units inboard (to the left in FIG. 12C) and ware axis AW is rotated B° clockwise (CW) at the trailing edge t of the collector C. Thus, the ware experiences compound movement from each encounter with a collector C.

Figure 14:
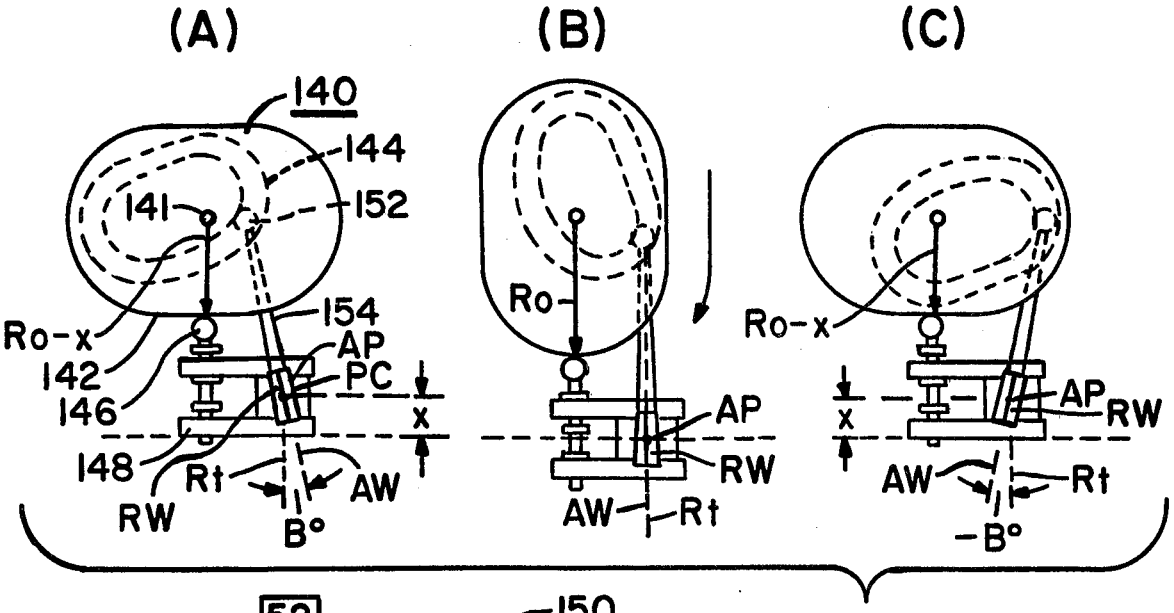
Figure 15A:
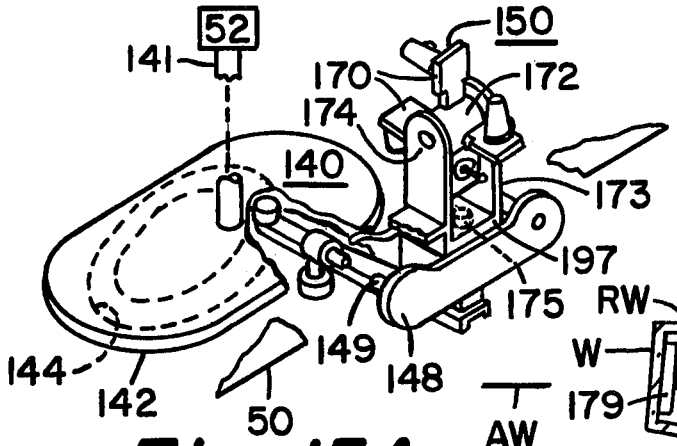
FIGS. 15A-15B illustrate details of the print transfer apparatus in respective perspective and side section views.
Figure 15B:
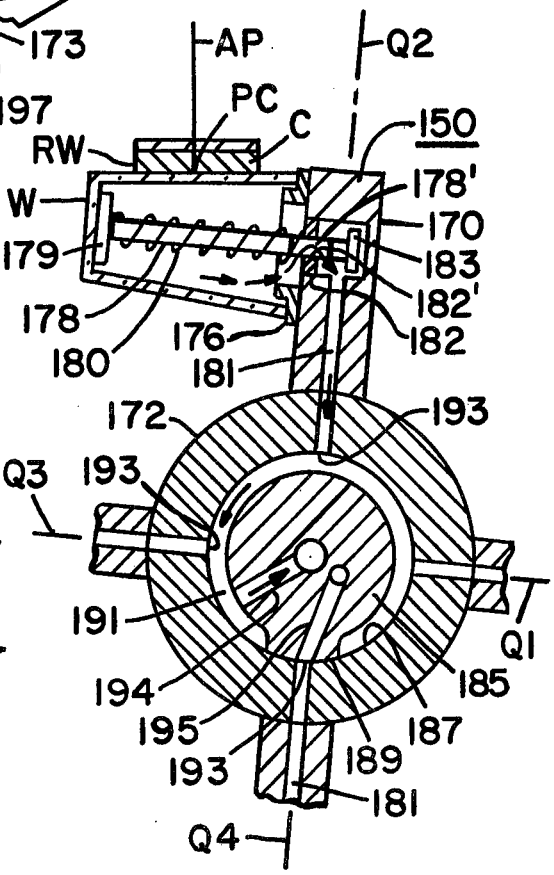

FIG. 14 at positions (A) through (C) and FIGS. 15A–15B demonstrate how a cam 140 is used to continuously position the ware W to align its apex A' with the collector apex A". The generated motion of the ware W, carried in chuck 150, is a combination of two motions at the point of contact PC, including a pivoting action of the ware about contact axis AP (perpendicular to the upper sidewall of the ware W) and a translation thereof along the radius of curvature Rt of turret 60, sometimes hereinafter referred to as radial line Rt.

The arc following arrangement is accomplished as follows. Cam 140, driven synchronously with turret 60 via the drive in base frame 52 (FIG. 5) and shaft 141 (FIG. 15A), has an outside profile 142 and an inside slotted profile 144. Let the radius of the cam 140 at the position shown in FIG. 14(A) be Ro-x and at FIG. 14(B) be $R_o$. Similarly, for a symmetrical object, at FIG. 14(C) the radius of cam 140 is R0-x. Outside cam follower 146 is mounted in a laterally movable yoke or frame 148 in print transfer assembly 58 and follows outside profile 142. Frame 148 is slidably mounted to table 50 by means of slide 149 and is restricted to linear motion thereby. The chuck 150 is carried in yoke 197 which in turn is rotatably secured to frame 148 via rotatable bearing 175 and is moved radially therewith along turret radial line Rt by means of the frame mounted cam follower 146. As cam 140 rotates clockwise, (see the progression in FIGS. 14A–14C) the ware W is translated along Rt by x units. It should be noted from FIG. 12(A) that, as the collector C advances, its radius Rc is colinear with the radius Rt of the turret 60 when the midpoint m of collector C lies along radial line Rt, half way through its advance through the printing station D10. Thus, the cam 140 adjusts the position of the print transfer assembly 58 so that the radial position of the ware W is displaced x units at the respective leading and trailing edges l and t of collector C, and zero at the midpoint m.

In order to correct for axis rotation, cam follower 152 carried by an arm 154 is operatively coupled to ware carrying chuck 150 via the rotatable bearing 175 sleeved in frame supporting yoke 197. The chuck 150 is adapted to be oriented so that contact axis AP of the ware W at the point of contact PC with the collector C is normal thereto. It is important to note that the bearing 175 be located in a position vertically beneath AP, such that, rotation of ware about AP is only motion generated due to rotation of yoke 197 about bearing 175. Thus, the ware W can rotate about its contact axis AP with collector C as well as translate laterally along the x direction of radius Rt. In the position (A) shown in FIG. 14, arm 154 is B degrees advanced (ie CCW), at FIG. 14(B) it is zero (0) degrees advanced or in line with turret radial line Rt, and at FIG. 14(C) it is −B advanced or B degrees retarded (i.e. CW). The combined motion provided by cam 140 maintains the ware ray RW aligned with the collector surface in correspondence to simulate two surfaces in nonslipapex-aligned-rolling-motion as described above.

The above system is workable for many ware shapes but requires a cam change for each ware profile. Further for some shapes it would not be advisable to extend the principle beyond certain practical limits. For example, reference is directed to FIG. 13B wherein, schematically, there are shown two articles to be decorated. Namely a cup WC and a bowl Wb. The cup is similar to that illustrated in FIG. 13A having a moderately steep side wall angle $\alpha c$ and a large end diameter Dc. A surface length Xc, along the surface of the cup Wc and extended to its apex A', is determined by the former two parameters. Surface wrap angle $\theta c$ is a function of the surface length Xc and diameter Dc. In the case of a cup, the wrap angle is relatively small as shown. A collector Cc for the cup can be fabricated to conform to the developed surface SC thereof (see also FIG. 13A), and the cup may be oriented as described above to produce apex coincidence with the collector Cc. This is true because the rotational and translational motion required is not severe and does not require reversal of the relative motion of the cup and the turret 60. Reversal of relative motion between turret 60 and the bowl Wb would occur when the wrap angle $\theta b$ inscribes the center of the collector Cb or exceeds 180° as shown. In the case of a bowl Wb shown in FIG. 13B, the wrap angle $\theta b$ is large and the developed surface Sb is consequently large. However as a practical matter a collector Cb for the bowl could only be practical over some wrap angle, e.g. $\theta b'$ less than 180° as shown. Thus, there is a significant difference in coverage. In the case of the cup all or part of the circumference over the developed surface thereof may be contacted (see cross hatched area) whereas in the case of a bowl, the circumferential coverage in one pass would be limited to the modified wrap angle $\theta b'$ over the developed surface (hatched area). Further, while with a cam change it is possible to print a diversity of articles, it may be preferable in certain instances to utilize a simplified embodiment described hereinafter. Before such alternative method is discussed however, an indexing feature of chuck 150 will be described by reference to FIGS. 5, 14, 15A and 15B.

The purpose of the chuck 150 is to receive ware W and secure to at the correct angle for engagement with a collector C. In order to accomplish this, a plurality of indexable paddles 170 are secured to a rotatable block member 172. The latter is rotatably journaled in opposed openings 174 in opposed upstanding support members 173 of yoke 197. The block 172 carries ware mating chuck pads 176 and depressable spring loaded vacuum pin 178.

In FIGS. 5 and **15*b* it can be seen that the ware W is indexed onto pad 176 when it is oriented horizontally (Q1 in FIG. 15B). Axial spring 180, retained between flange 179 at the distal end of pin 178, is depressed by engagement of the pin 178 with the inside of the ware W as it mates with plate 176. The pin 178 is sleeved through opening 182' in bushing 182 which is coupled to a vacuum line 181 in paddle 170. The pin 178 has a notched portion 178' and foot valve 183 located at a proximal end thereof. As the ware W seats against mating pad 176, pin 178 moves inwardly of bushing 182 opening vacuum line 181 to inside the ware via notched portion 178'**, thereby holding the ware firmly into position (see arrows).

Vacuum is maintained in three quadrants Q1–Q3 of the rotation of block 172 and is cut off at Q4 as follows. Sector shaft 185, located concentrically in opening 187 of block 172, carries seal edge 189. Vacuum line 194 has access to a space 191 between sector shaft 185 and the opening 187. The space 191 is normally under vacuum or reduced air pressure and communicates with the interior of the ware W over vacuum line 181 via ports 193. As the ware is loaded at Q1, the pin 178 and spring 180 are depressed opening foot valve 183. The ware W, secured by vacuum, is carried from Q1 to Q2 for decoration by engagement with collector C. Thereafter it is moved to idle position Q3 still under vacuum and thence to Q4 where seal edge 189 blocks port 193 to vacuum line 194. An air line 195 supplies air to port 193 in the Q4 position to supply air into vacuum line 181 to thereby blow the ware W off paddle 170 via the vacuum path described above. As the ware W moves sufficiently from pad 176, foot valve 183 closes or blocks the opening 182' in bushing 182. Vacuum is restored when the paddle 170 advances from Q4 toward Q1, seal edge 189 passing port 193 and foot valve 183 opening by loading new ware. A missed loading will therefore allow maintained vacuum integrity, since foot valve 183 will be maintained closed by spring 180 holding shaft 178 to the left. Sector shaft 185 can be rotated during set-up and for timing, but is then locked into stationary position.

The rotatable block 172 carrying the paddles 170 is driven by a barrel cam actuated drive 186, such as a 8/2 FH 62–120 roller gear drive manufactured by Ferguson Machine Co., through one of two journaled ends 174 of the rotatable block 172 (see FIG. 5). The drive 186 is actuated synchronously with the turret 60 via drive shaft 188 which includes slidable spline coupling 200, a pair of universal joints 201, one each at opposite ends of coupling 200 as shown, and opposed shaft extensions 199 coupled to each universal 201. One shaft extension is coupled to drive 186 via a chain or pulley 205. The opposite shaft extension 199 is secured in bearing 195. Pulley 190 is mounted to the free end of shaft extension 199. Another pulley 192 is coaxially driven with a bearing mounted pinion 194 engaging the ring gear 62. The pinion 194 and pulley 192 are appropriately secured by block 196 which is in turn secured to the base table 50 by frame member 198. Belt 197 couples pulleys 190 and 192.

For ten (10) stations D1–D10 the ratio of the pinion 194 to the ring gear 62 is chosen such that each 1/10 rotation of the turret 60 causes shaft 188 to rotate one turn. Shaft 188 is splined at coupling 200 to move axially as frame 148 moves radially x units as described above. Also universal joints 201 allow the shaft 188 to rotate while the frame is advanced and retarded over the 2B degree swing. As shaft 188 rotates once, it actuates drive 186 so that the barrel cam (not shown) therein causes the block 172 and paddles 170 carrying ware W to rotate intermittently 90° or ¼ turn into quadrant Q2 just prior to the time that a collector C enters the print transfer station at D10. Note that the orientation of the paddles 170 at position Q2 is illustrated in FIG. 15B and shows that ware W is aligned with collector C so that axis AP, normal to the ware surface, is perpendicular to collector C. As the collector C comes into engagement with the ware W, friction causes the ware W to rotate in nonslipping relation with the collector C. The ware W then is indexed out of quadrant Q2 by a ¼ rotation of block 172 to face downwardly in quadrant Q3 on the inboard side of the print transfer device 58 as shown in FIG. 5. Finally on the next indexing step, the ware W is moved nearly horizontal into the lowermost quadrant Q4 for ejection and removal by conveyor means (not shown). As explained above, at this portion of the cycle vacuum is cut off by valve action within block 172, thereby releasing the ware W, while the spring 180 and positive air pressure from air line 195 urge the ware away from plate 176 and onto conveyor means (not shown). On the next loading at quadrant Q1, the vacuum is reset.

Figure 13C:
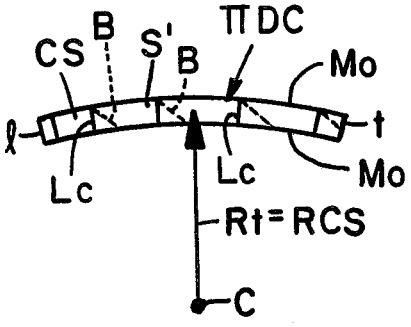
Figure 13B:
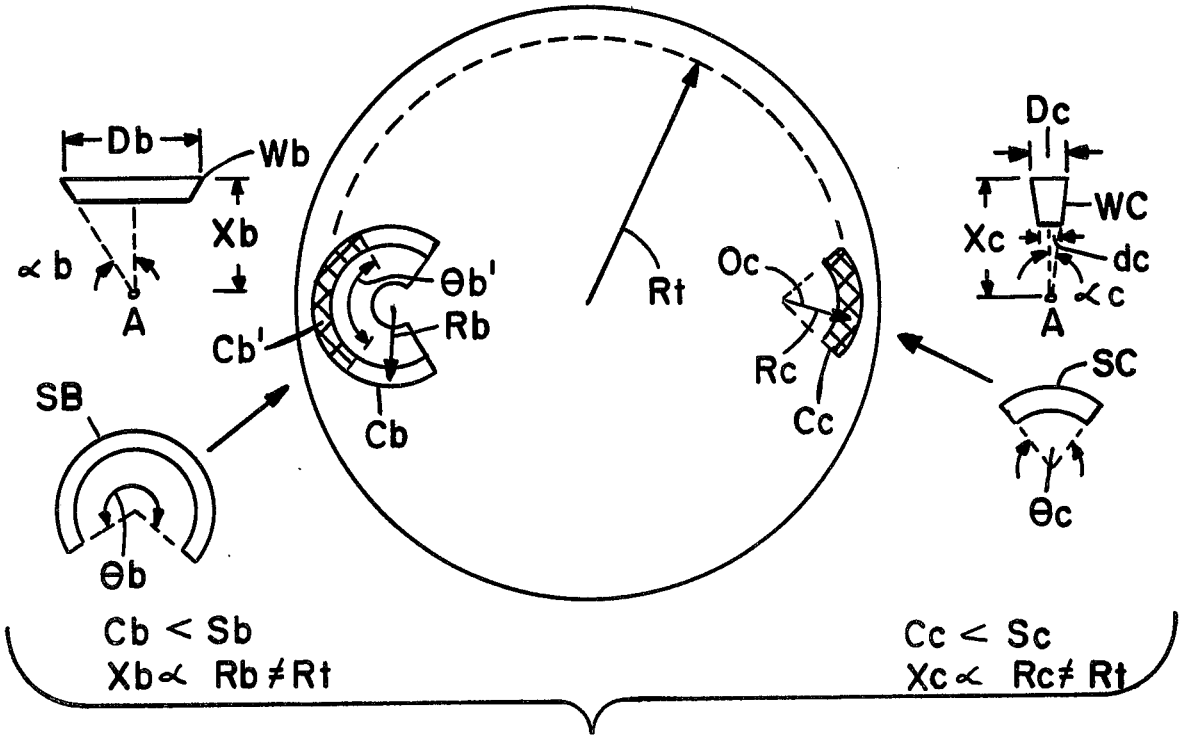

In an embodiment of the present invention, described herein with respect to FIG. 14B and in greater detail in the above mentioned patent application Ser. No. 332,722, it is proposed that the cam following print transfer device 58 be held fixed in the position shown in FIG. 14(B) with all axes aligned. In order to accomplish this, the print collector C would be modified so that its radius of curvature Rc is aligned with and corresponds to that (Rt) of the turret table 60. The ware W would then be oriented by chuck 150 at a fixed position, e.g. aligned with the radius Rt of the turret 60. In FIG. 13C, there is shown a reformed collector CS having a modified developed surface S'. The reformed collector CS has a radius of curvature RCS equal to the turret radius Rt and having the same center C. A piece of conical ware or cup WC such as in FIG. 13B has respective large and small end diameters DC and dc. The large diameter defines a circle having a perimeter $\pi$(DC) and likewise the small diameter dc defines a circle having a circumference $\pi$ (dc). In FIG. 13C it is given that outboard margin Mo of modified developed surface S' has an arc length from respective leading to trailing edges l and t equal to the large circumference $\pi$(DC) of cup WC. The inboard margin Mo has a length which is different i.e. greater than the circumference $\pi$(dc) of the small end of cup WC. If it is also given that cup WC rolls without slipping then all points on cup WC move across modified surface S' without slipping. The large end of the cup WC will trace an arc in correspondence with the outboard margin Mo of modified surface S'. However, the small end of cup WC will not trace an arc in correspondence with the inboard end Mo of surface S' because inboard line Mo is longer than the circumference $\pi$dc of the small end of cup WC. If no slipping occurs between cup WC and reformed collector CS along a line of contact Lc therebetween then the collector CS must become progressively distorted. This is symbolized by the progressive angular shift of the dotted line B representing the distortion or bulge across collector CS. Note that as the reformed collector CS moves from right to left bulge B appears to rotate to the left.

Figure 16:
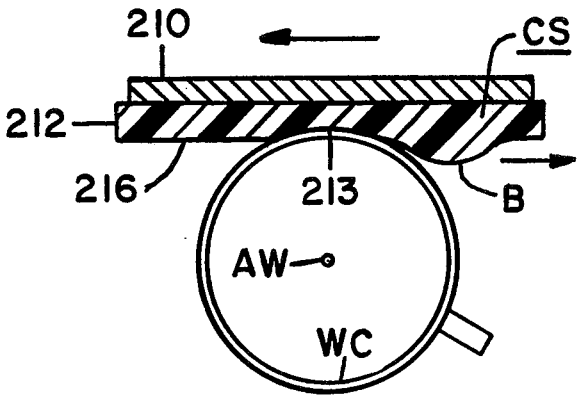
FIG. 16 is a fragmented side section of an alternative embodiment of the print transfer apparatus.

In FIG. 16 the above is best illustrated in side section near the small end of the cup WC. The cup WC has stretched or pushed the collector CS away from itself as bulge B in the surface of the collector CS. The reformed collector CS carried by support 210 includes an elastomer pad 212 having a working surface 216 corresponding to the modified developed surface S'. The cup WC engages collector CS at 213. As the collector CS moves to the left, the small end of the cup WC forces or stretches the elastomer to the right. This occurs because the length of arc traversed by the small end of the cup WC is less than the arc length of the inboard margin Mo of the collector CS. Since the ware WC does not slip, the elastomer pad 212 gives such that it may be forced out of the path of cup WC forming the bulge B.

The decoration (not shown) on the underside or working surface 216 of the pad 212 is correspondingly distorted or stretched by the forced fitting action. However, for certain types of decorations (e.g. florals) this is immaterial since it is not critical in appearance. On the other hand, in very symmetrical designs with exacting geometric shapes, the distortion caused by this stretch printing effect can be corrected by appropriate modification of the designs installed on the etch cones 72. This might be accomplished by iteration of design manufacture or by some computer assisted graphics technique to compensate therefor.

Figure 17A:
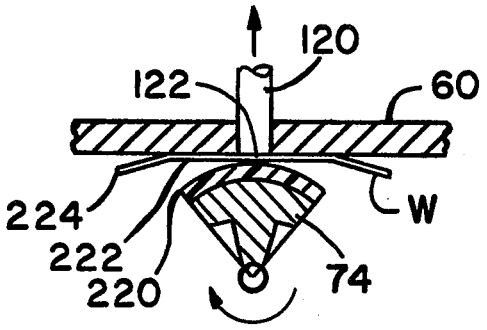
FIGS. 17A-17B are fragmented side section and top views of a hollow ware printing head.
Figure 17B:
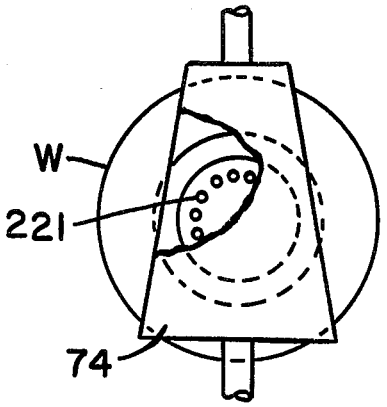

In another embodiment of the present invention, illustrated in FIGS. 17A and 17B, flatware W is substituted for the collectors C. In this arrangement the ware W itself is held against the rotating turret table 60 by reduced pressure operating through vacuum line 120 and hole 122 therein. The transfer cone 74 has an elastomer pad 220 thereon for carrying the design 221. The pad 220 is cut away to clear rim portions 224 of the ware so that it engages only the central portion 222 thereof.

Figure 18:
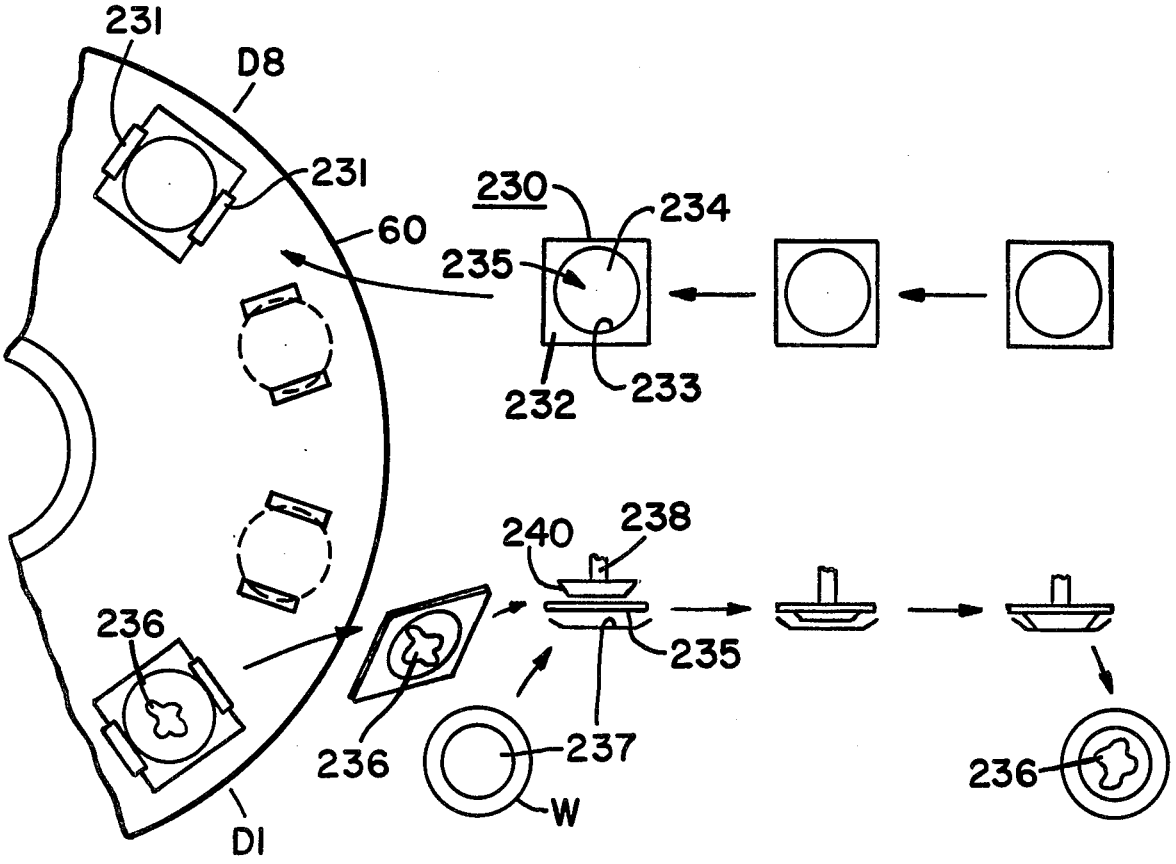
FIG. 18 is a schematic showing a flexible membrane printing head and ware throughout relative thereto.

In yet another embodiment of the present invention, means is described for printing the entire inside surface portion of the ware W. In FIG. 18, for example, full print flatware and hollow ware membrane collectors 230 may be adapted for providing a full print of the inside surface 237 of a piece of hollow ware W shown. The membrane collectors 230 include a frame member 232 of a rigid material having an opening 233 into which is disposed an elastic membrane elastomer 234 having a working surface 235. In this arrangement the membrane collectors 230 are periodically indexed into the turret 60 and carried by supports 231 at stations beginning with D8. Indexing of the membrane collectors 230 may be accomplished manually or by mechanical means not shown. As each membrane collector 230 is rotated about in a direction shown by the arrows, it encounters the various print stations 54 (see FIG. 5), contacts the transfer rolls 74, and receives on its working surface 235 the full extent of the various colors of the design 236. Each membrane collector 230 is then indexed from the turret 60 and aligned for engagement with a piece of ware W as illustrated. The ware W is placed below the membrane collector 230 and a piston 238 having a deformable shaped face 240 engages with the elastomer 234. The shaped face 240 distorts the elastomer 234 so as to intimately conform with the entire surface of the inner portion 237 of the ware W. Thereafter the piston 238 is withdrawn and the ware W has the design 236 transferred thereto on all portions of the inside surface 237. Thus, full coverage of hollow ware can be accomplished using the flexible membrane collector technique.

FIGS. 19A and 19B show in cross section the detail of the arrangement illustrated in FIG. 18 wherein the ware W may be a glass or glass-ceramic article. The membrane collector 230 is placed above the ware W. The elastomer 234 is distorted by the shaped face 240 which is urged thereagainst. The design 236 on the underside or working surface 235 of elastomer 234 transfers onto the ware W by intimate contact. The profile of the shaped face 240 allows the elastomer to distort center first, urging the elastomer 234 in contact with the inner center portion 237 of the ware so that there is no trapped air during the printing operation. Shaped face 240 and elastomer 234 both together distort to conform to and reach rim 233'. Thus the print proceeds from the center 237 to the rim 233'. Adjustable stops 239 establish spacing between shaped face 240 and frame 232. This flexible membrane technique and details of variations thereof are described in one of the above mentioned copending patent applications, namely Ser. No. 332,723.

The cleaning assembly 56 is shown in place at D9 on the machine base table 50 in FIG. 6. It is simply a solid conical surface or cone 160' (steel, aluminum, etc.) geared via pinion 162' with ring gear 62 to roll against the collectors C as they pass overhead. Any ink that has been left on the collectors C (resulting from an incomplete transfer to ware or missing ware at the transfer station D10), is transferred to the cone 160'. A scraping blade assembly 164' floatably mounted in pressure block 165' (similar to applicator/doctor assembly in FIG. 3) removes excess ink from the surface of the cone 160'. The cleaning assembly 56 assures clean collectors C before reprinting in each cycle.

A feature of the present invention, shown schematically in FIG. 6, that is useful in establishing accurate set up of the printing apparatus, is the use of leveling plates 166 onto which are mounted the collectors C, the printing station assemblies 54, and the cleaning assembly 56. These leveling plates 166 are individual mounting pads which are adjusted to an accurate mounting position during set up with locking adjustment screws 168. They can then be used as precision mounts for supporting the print station assemblies 54, including corresponding etch cones 72 and transfer cones 74. They also can be used for positioning the collectors C. In conventional decorating devices ware must be printed to check registration of the design colors. In the present invention a visual inspection of the collectors C will allow the operator to check registration prior to printing ware. Fine adjustments to registration can be easily accomplished by the adjusting screws 79 and collar clamp 275 hereinbefore described. Since the cleaning station assembly 56 removes all ink upon each complete rotation of turret 60 registration can be quickly rechecked and adjusted prior to actual production.

Since it is a feature of the present invention to print to a flat surface (e.g. collector, flatware, membrane collector, etc.) other embodiments are set forth below for the purpose of disclosing variations in the above concept.

Figure 20A:
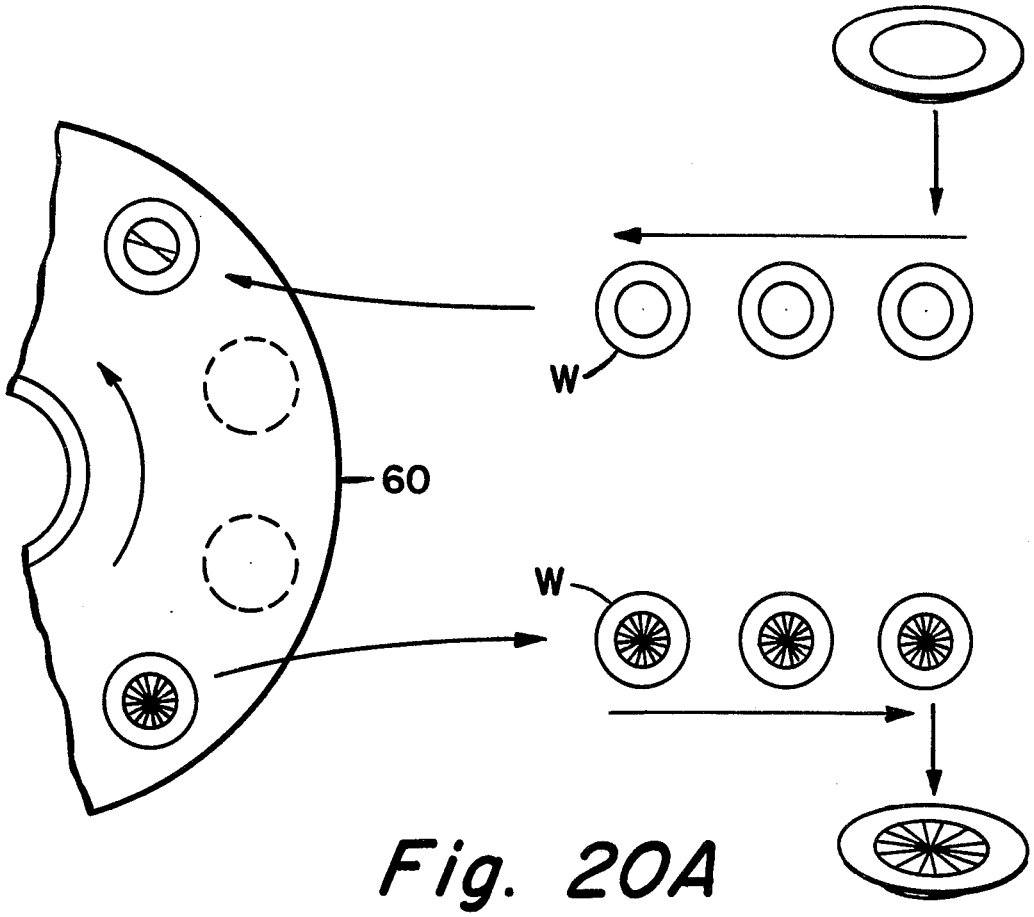
FIGS. 20A-D are schematic drawings illustrating alternate embodiments of print transfer mechanisms.

In FIG. 20A the ware W is carried by turret 60 and printed as it progresses through the various print stations (i.e. the ware W acts as a collector). Ware W is held in turret 60 by vacuum as set forth and described earlier herein with respect to FIGS. 17A–17B.

Figure 20B:
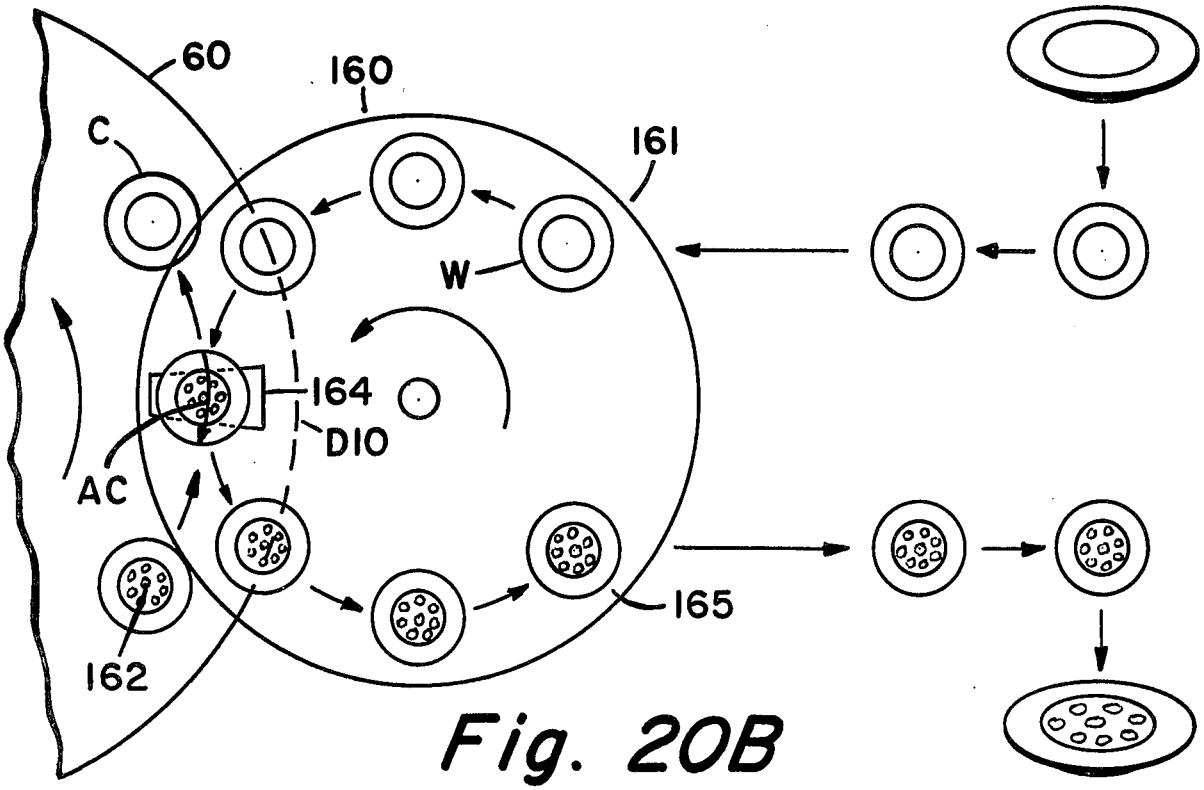

In FIG. 20B a second turret 160 carries ware W from an inlet end 161 by means of a similar vaccum arrangement. The turret 60 carries collector C which may be flat, circular elastomer pads. After each collector C receives a full design 162, it engages a takeoff cone 164 which picks up design 162 and transfers it to ware W at the print station D10. The takeoff cone 164 may be similar to the one shown in FIG. 17A except that it removes the design 162 from the collector C and transfers it to the ware W. In FIG. 17A, the transfer cone 74 receives a portion of the design from an etch cone to print a portion of the design onto the ware W, acting as a collector. In the embodiment shown in FIG. 20B, the takeoff cone 164 receives the entire design from collector C for complete transfer to the ware. Turret 160 acts as an automatic ware in/ware out carrier. The printed ware W is ejected from turret 160 at outlet 165.

In FIG. 20E a side view of the arrangement of FIG. 20B is shown. Notice that turret 60 and second turret 160 are offset by the angle of take off cone 164. Also, during the interval when the take off cone 164 engages ware W the latter must follow arc AC or path that coincides with the motion of take off cone 164 in the plane of second turret 160. The ware W may be mounted or secured on second turret 160 by means of a slidable chuck 167 which allows the ware to move in the direction of double headed arrow AW in order to follow arc AC in the plane of turret 160 as the take off cone deposits its design onto the ware.

Figure 20D:
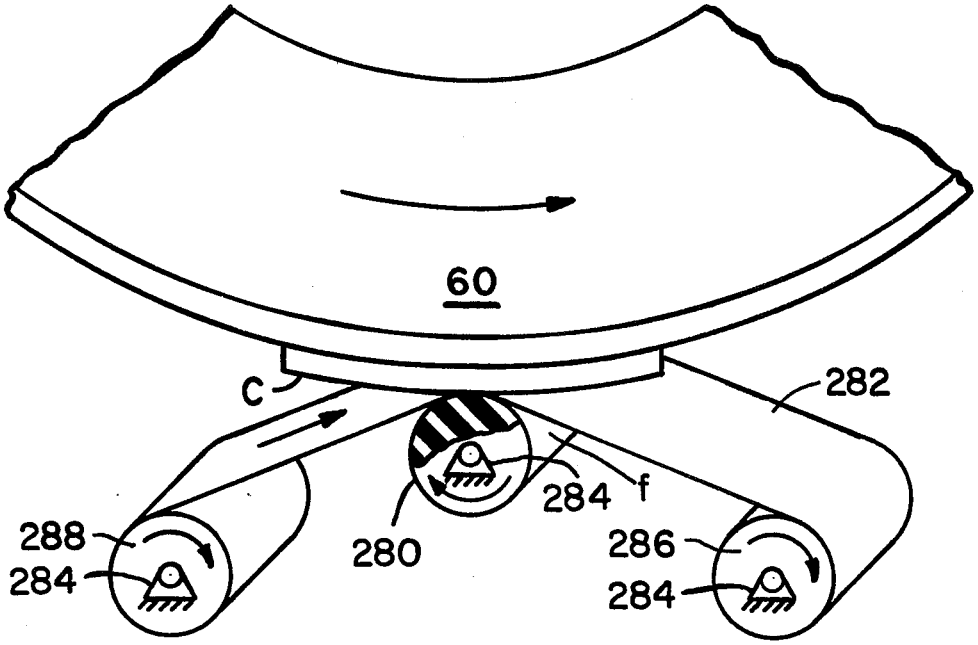
Figure 20C:
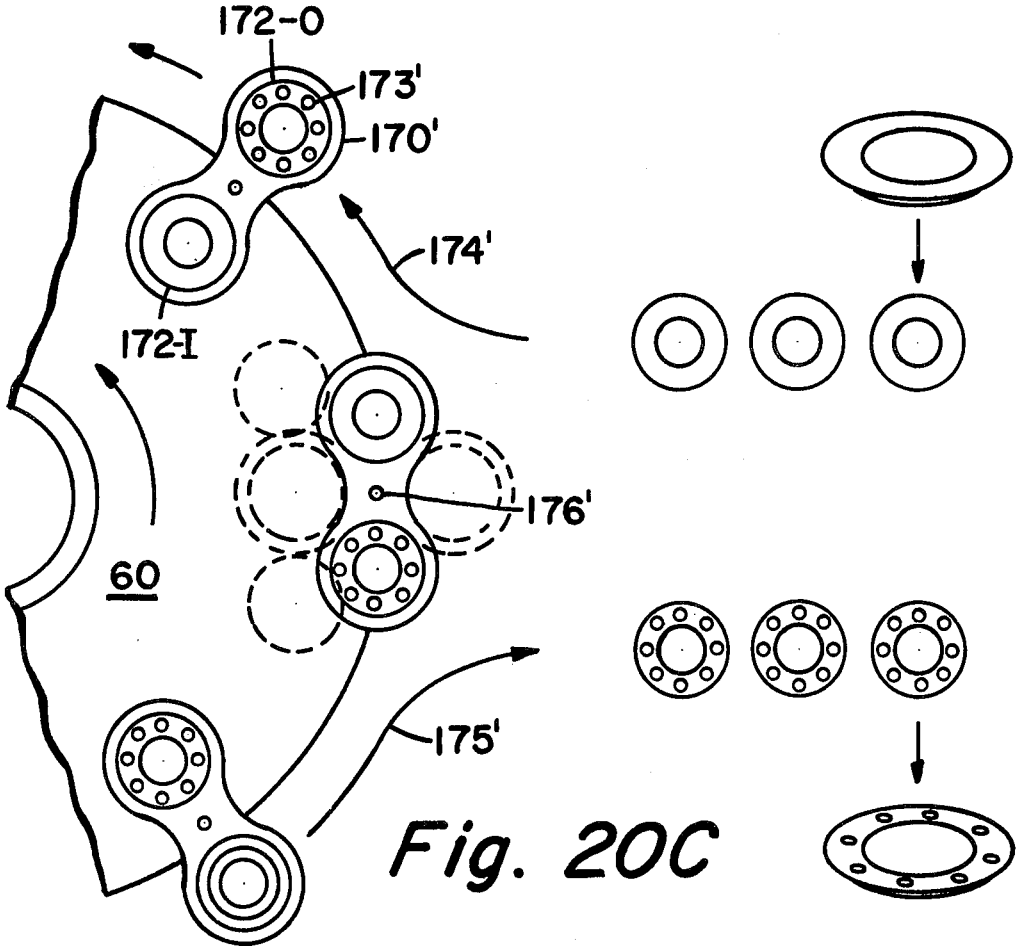

In FIG. 20C a variation of the ware in/ware out arrangement of FIG. 20B is illustrated. In this embodiment turret 60 carries a plurality of pivotally mounted membrane fixtures 170'. Each carries a pair of respective inboard and outboard membrane collectors 172-I-172-O. Ware W may be carried about a path illustrated by the arrows by a conveyor (not shown) starting at inlet end 174' of turret 60. The outboard membrane collector 172-O, carries design 173' and means (not shown), similar to the arrangement of FIGS. 19A–19B, which causes the outboard collector 172-O to be intimately contacted with ware, for transferring the design 173' as the outboard collector 172-O and ware travel together with turret 60. After printing, the ware W is removed from engagement with outboard collector 172-O at outlet end 175' of turret 60. Thereafter the membrane fixture 170' pivots about support bearing 176' prior to entering inlet end 174'. The now blank outboard collector 172-O thus becomes the inboard collector 172-I which may be printed, and the inboard collector 172-I carrying design 173' moves to the outboard position. The former receives the design 173' from print stations as described earlier while the outboard collector 172-O simultaneously prints the ware.

Other variations are possible and within the scope of printing to any suitable flat surface and the like. For example, in yet another embodiment of the present invention of FIG. 20D collectors C, carried by turret 60, print a decoration or decal to a decal medium 282, supported against collector C by a cylindrical backing roll 280. Respective cylindrical wind and unwind rolls 286–288 serve known functions. The backing roll 280, and respective wind and unwind rolls 286 and 288 may be mounted on a common support 284 shown schematically. The common support may be articulated in the circumferential and radial direction of the turret as set forth hereinbefore relative to FIGS. 11–15*b*, to compensate for differences between the respective geometries of the decal medium or web 282, the turret 60 and collector C. Also, forced or stretched printing as set forth in connection with the description of FIGS. 13C and 16 may be accomplished.

It should be understood that in the above embodiment of FIG. 20D, backing roll 280 should have a high coefficient of friction surface f for engagement with the medium 282. The surface f may be formed of relatively hard rubber. The backing roll 280 is cross hatched to show this feature. Alternatively, the roll 280 could be metal having a sleeved rubber cover or a suitable adhesive.

In either of the embodiments set forth above, it is important to maintain a nonslip relation between the backing roll 280 and the medium 282 and the collector C so that the medium does not move either radially or circumferentially relative to the backing roll collector. This assures that the medium acts as a rigid surface, fixed instantaneously with respect to the backing roll 280 and the collector C. Thus, distortion of the design and misregistration thereof on medium 282 is avoided.

In copending patent application Ser. No. 332,725, a method for applying design configurations to the etch cones 72 is described. The method described therein teaches an alignment system so that when the etch cones 72 are placed in service, minimum adjustment is required to accomplish registration.

Other arrangements of the apparatus of the present invention are possible. For example, multiple transfer stations may be provided at selected circumferential locations and, depending on the ware to be printed, one of the transfer locations may be utilized while others are left idle. This can more readily be appreciated if it is assumed that multicolor printing may be accomplished in about four of the print stations leaving table space for extra transfer stations.

The apparatus of the present invention is useful in lithographic, planographic, typographic or gravure printing processes. Thermoplastic inks are preferred but solid or aqueous based and organic inks that do not need to be fired can also be used. Printing can be made directly to ware or to decal paper but the preferred embodiment is to print to a silicone collector surface which subsequently transfers its multicolor print to ware in a single transfer step.

Each of the etch cones 72 may be formed with a portion of a design. One ink color for each printing assembly 54 would be supplied to the ink applicator assembly 82 described above and registerable portions of the composite design would be each printed on the collectors C in sequence. As described above, ware W may be indexed into position thereunder and sequentially printed with the composite design.

It is also possible to interpose an additional offset pickup cone at the transfer station D10 for printing to all variations of objects.

While there have been described what are considered to be the preferred embodiments of the present invention, it will be obvious to those skilled in the art that various changes and modifications may be made therein without departing from the invention, and it is intended in the appended claims to cover all such changes and modifications as fall within the true spirit and scope of the invention.

We claim:

1. A printing apparatus for decorating surface portions of articles which comprises:

means for creating a complete design to ultimately be transferred to the surface of an article to be decorated;

said creating means including a plurality of arcuately spaced-apart printing stations positioned radially about an axial center of rotation, with each station having means for creating a portion of said complete design;

each of said printing stations including a first conical surface having a first central axis with the apex of said first conical surface lying therealong, said first conical surface being mounted for rotation about said first central axis, and a second conical surface having a second central axis with the apex of said second conical surface lying therealong, and means for mounting said second conical surface for rotation about said second central axis in continuous contact with said first conical surface along a line of contact therebetween for forming a portion of the design on said second conical surface;

means for collecting the design portions from each of the printing stations, including a planar collector surface mounted for rotation in a plane about said axial center of rotation;

said collector surface and the second conical surface of each of said printing stations being mounted for periodic engagement with each other along a line of contact therebetween for transferring the design portion from each said second conical surface to said collector means for forming a complete design thereon;

the line of contact between said first and second conical surfaces and the line of contact between each second conical and said collector surface intersecting at a point coincident with said axial center of rotation of said collector surface and coincident with the apex of each of said first and second conical surfaces; and, means for transferring the complete design from said collector surface to surface portions of an article to be decorated.

2. A printing apparatus as defined in claim 1 wherein said collector surface comprises an elastomer surface having a higher affinity for the design than the second conical surface.

3. A printing apparatus as defined in claim 1 wherein said transfer means comprises support means for positioning the article to be decorated in engagement with said collecting means along a line of contact therebetween, and including means for selectively indexing the support means and the article into and out of contact with said collecting means.

4. A printing apparatus as defined in claim 1 wherein said collector surface has a radius of curvature and a corresponding center thereof adapted to follow a path concentrically about said axial center of rotation, and the article to be decorated having a conical shape with a surface ray intersecting its axis of rotation at the article apex;

support means for supporting said article to be decorated;

camming means operatively coupled to said support means for engaging the article with said collector surface such that a line of contact between the article and the collector surface includes the surface ray of the article and the radius of curvature of the collector surface, with the article apex being coincident with the center of the collector surface.

5. A printing apparatus as defined in claim 1 wherein said collector surface includes a flexible membrane for intimately contacting said second conical surface in a nonslip relationship.

6. A printing apparatus for decorating articles comprising:

at least one first means for establishing a design including a first conical surface having a first central axis and a cone apex lying along said first central axis, said first conical surface being mounted for rotation about said first central axis, and a second conical surface intimately contacting the first conical surface along a line of contact, said second conical surface having a second central axis and cone apex lying thereon, and being mounted for rotation about said second central axis;

at least one second means for collecting the design by intimate contact with the first means including a planar collector surface being mounted for rotation in a plane about a center of rotation therein, said first and second conical surfaces and the collector surface being mounted relative to each other such that the respective apex of each of the first and second conical surfaces are coincident with each other and the center of rotation of the collector surface, the first and second conical surfaces are in intimate nonslip contact with each other along the line of contact therebetween for forming the design, and the collector and the second conical surface are in periodic engagement with each other in intimate nonslip contact along a respective line of contact therebetween for transferring the design from the second conical surface to said collector, the line of contact between the first and second conical surfaces and the line of contact between the second conical surface and the collector intersecting at a point coincident with the center of rotation of said collector and coincident wih the aforementioned apex of each of the first and second conical surfaces;

means for transferring the design to the article by intimate contact with said collector;

said second conical surface including an inking surface portion formed of a relatively hard, ink film receiving material; and, doctoring means mounted for engagement with the second conical surface having at least two working surfaces, each having an interface in close contact with the second conical surface, and each interface lying along a locus of points upon the second conical surface and being apex coincident therewith.

7. A printing apparatus as defined in claim 6 further including means for depositing an inking fluid at an inboard end of the doctoring means closest to the center of rotation of the collector surface, and means for collecting over flow from an outboard end thereof, radially outwardly of said inboard end, the doctoring means and second conical surface being oriented for allowing gravity flow of the inking fluid from the inboard to the outboard ends thereof.

8. A printing apparatus as defined in claim 6 further including resilient bearing means engaging the doctoring means for urging it on a seating relation with the second conical surface.

9. A printing apparatus as defined in claim 6 wherein the inking surface includes engraved portions for establishing a portion of a design.

10. A printing apparatus for decorating articles comprising:

at least one first means for establishing a design including a first conical surface having a first central axis and a cone apex lying along said first central axis, said first conical surface being mounted for rotation about said first central axis, and a second conical surface intimately contacting the first conical surface along a line of contact, said second conical surface having a second central axis and cone apex lying thereon, and being mounted for rotation about said second central axis;

at least one second means for collecting the design by intimate contact with the first means including a planar collector surface being mounted for rotation in a plane about a center of rotation therein, said first and second conical surfaces and the collector surface being mounted relative to each other such that the respective apex of each of the first and second conical surfaces are coincident with each other and the center or rotation of the collector surface, the first and second conical surfaces are in intimate nonslip contact with each other along the line of contact therebetween for forming the design, and the collector and the second conical surface are in periodic engagement with each other in intimate nonslip contact along a respective line of contact therebetween for transferring the design from the second conical surface to said collector, the line of contact between the first and second conical surfaces and the line of contact between the second conical surface and the collector intersecting at a point coincident with the center of rotation of said collector and coincident with the aforementioned apex of each of the first and second conical surfaces;

means for transferring the design to the article by intimate contact with said collector; and, a conical cleaning surface having a central cleaning surface axis and a cone apex therealong, said cleaning surface being mounted for rotation about the central cleaning surface axis and having its cone apex in correspondence with that of the center of rotation of the collector surface, and oriented to intimately contact the collector surface along a line of contact common thereto in a nonslip relationship.

11. A printing apparatus for decorating articles comprising:

at least one first means for establishing a design including a first conical surface having a first central axis and a cone apex lying along said first central axis, said first conical surface being mounted for rotation about said first central axis, and a second conical surface intimately contacting the first conical surface along a line of contact, said second conical surface having a second central axis and cone apex lying thereon, and being mounted for rotation about said second central axis;

at least one second means for collecting the design by intimate contact with the first means including a planar collector surface being mounted for rotation in a plane about a center of rotation therein, said first and second conical surfaces and the collector surface being mounted relative to each other such that the respective apex of each of the first and second conical surfaces are coincident with each other and the center of rotation of the collector surface, the first and second conical surfaces are in intimate nonslip contact with each other along the line of contact therebetween for forming the design, and the collector and the second conical surface are in periodic engagement with each other in intimate nonslip contact along a respective line of contact therebetween for transferring the design from the second conical surface to said collector, the line of contact between the first and second conical surfaces and the line of contact between the second conical surface and the collector intersecting at a point coincident with the center of rotation of said collector and coincident with the aforementioned apex of each of the first and second conical surfaces; and, said collector surface forming the article to be decorated.

12. A printing apparatus for decorating articles comprising:

at least one first means for establishing a design including a first conical surface having a first cental axis and a cone apex lying along said first central axis, said first conical surface being mounted for rotation about said first central axis, and a second conical surface intimately contacting the first conical surface along a line of contact, said second conical surface having a second central axis and cone apex lying thereon, and being mounted for rotation about said second central axis;

at least one second means for collecting the design by intimate contact with the first means including a planar collector surface being mounted for rotation in a plane about a center of rotation therein, said first and second conical surfaces and the collector surface being mounted relative to each other such that the respective apex of each of the first and second conical surfaces are coincident with each other and the center of rotation of the collector surface, the first and second conical surfaces are in intimate nonslip contact with each other along the line of contact therebetween for forming the design, and the collector and the second conical surface are in periodic engagement with each other in intimate nonslip contact along a respective line of contact therebetween for transferring the design from the second conical surface to said collector, the line of contact between the first and second conical surfaces and the line of contact between the second conical surface and the collector intersecting at a point coincident with the center of rotation of said collector and coincident with the aforementioned apex of each of the first and second conical surfaces;

means for transferring the design to the article by intimate contact with said collector; and, means for engaging the collector surface including a third conical surface having a cone axis and a cone apex lying thereon, said third conical surface being mounted for rotation about its cone axis and oriented such that its cone apex is coincident with the apex of the first and second conical surfaces and the center of rotation of the collector surface, and said third conical surface engaging the collector surface in intimate nonslip relation along a line of contact, which line includes the point of coincidence between the cone apex and the center of rotation of the collector surface.

13. A printing apparatus as defined in claim 12 further including means for securing the articles with respect to said third means for intimate contact therewith in a nonslip relationship for receiving the design portion thereon.

14. A method of printing articles comprising the steps of:

radially locating axes of rotation of a plurality of conical printing means about a central axis, each axis of rotation including an apex of said conical printing means therealong;

producing a plurality of transferrable design portions at each of said printing means;

locating a collector for engagement with each of the printing means concentrically about a center of rotation corresponding to said central axis;

orienting the printing means and collector for engagement along a line of contact such that centers of rotation of the collector means are coincident with the apex of each of said printing means;

transferring the design portion from the printing means to the collector by intimate contact of one with the other along the common line of contact therebetween, which line includes the apex of each printing means and the center of rotation of the collector;

engaging the article to be printed with the collector for transferring the design thereto;

locating the article to be printed such that a line of contact between said article and the collector surface lies on a surface portion of the article and intersects the central axis at the center of rotation of the collector; and, manipulating each one of radial and circumferential orientation of the article for engagement with the collector surface in a radial line thereof.

15. A method of printing articles which comprises:

locating a plurality of pairs of first and second conical printing rollers about an axial center of rotation;

mounting each said pair of first and second conical printing rollers for rotation about their respective axes such that the apexes of said first and second rollers lie along said axes and are coincident with said axial center of rotation;

rotating each said pair of first and second conical printing rollers about their axes in line contact with one another to form and transfer a portion of a design from one roller to the other;

rotating a planar collector surface about said axial center of rotation and sequentially engaging the second rollers of said plurality of pairs of printing rollers to collect the design portion therefrom and form a complete design on the collector;

engaging the collector with each of said second rollers along a line of contact which line intersects the apexes of each of said printing rollers and the axial center of rotation of said collector;

and engaging an article to be printed with the collector for transferring a complete design thereto.

16. A method of printing as defined in claim 15 wherein the step of transferring the design portion from the printing means to the collector includes the step of, intimately engaging respective surface portions thereof in rolling contact.

17. A method of printing as defined in claim 15 further including the step of, impressing upon printing means at least one of a plurality of color separated design portions and registering each of said design portions in correspondence with one another.

18. A method of printing as defined in claim 15 further including the step of, indexing the article to be printed respectively into and out of position for engagement with the collector means.

19. A method of printing as defined in claim 15 including the step of; locating a conical transfer surface having an axis of rotation and apex therealong for intimate engagement with the collector; orienting said transfer surface apex such that it is coincident with the center of rotation of said collector means; engaging the transfer surface into intimate contact with the collector means for receiving therefrom the design; and engaging said transfer surface thereafter with the article to be printed for transferring the design portion thereto.

* * * * *